US011752763B2

(12) United States Patent
Yamamichi et al.

(10) Patent No.: US 11,752,763 B2
(45) Date of Patent: Sep. 12, 2023

(54) LIQUID EJECTION APPARATUS AND HEAD UNIT

(71) Applicant: SEIKO EPSON CORPORATION, Tokyo (JP)

(72) Inventors: Shunsuke Yamamichi, Nagano (JP); Yusuke Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 12 days.

(21) Appl. No.: 17/385,048

(22) Filed: Jul. 26, 2021

(65) Prior Publication Data

US 2022/0024204 A1 Jan. 27, 2022

(30) Foreign Application Priority Data

Jul. 27, 2020 (JP) ..... 2020-126245

(51) Int. Cl.
*B41J 2/14* (2006.01)
*B41J 2/045* (2006.01)

(52) U.S. Cl.
CPC ..... *B41J 2/04581* (2013.01); *B41J 2/04588* (2013.01); *B41J 2/1433* (2013.01); *B41J 2/14201* (2013.01)

(58) Field of Classification Search
CPC ..... B41J 2002/14491
See application file for complete search history.

(56) References Cited

U.S. PATENT DOCUMENTS

| | | | | |
|---|---|---|---|---|
| 7,322,677 | B2 * | 1/2008 | Silverbrook | B41J 2/155 347/49 |
| 2015/0062215 | A1 * | 3/2015 | Shirato | B41J 2/04573 347/9 |
| 2016/0082724 | A1 * | 3/2016 | Date | B41J 2/04588 347/10 |
| 2016/0167382 | A1 | 6/2016 | Date | |
| 2018/0086054 | A1 * | 3/2018 | Abe | B41J 2/04541 |
| 2018/0178510 | A1 | 6/2018 | Nakajima | |
| 2018/0361765 | A1 * | 12/2018 | Sago | B41J 2/14 |

FOREIGN PATENT DOCUMENTS

JP 2016-112694 A 6/2016

* cited by examiner

*Primary Examiner* — Shelby L Fidler
(74) *Attorney, Agent, or Firm* — Global IP Counselors, LLP

(57) ABSTRACT

A liquid ejection apparatus includes a head unit that ejects a liquid, and a control unit that controls an operation of the head unit, wherein the head unit includes a drive signal output circuit that outputs a drive signal, a first substrate on which the drive signal output circuit is provided, and a first ejection head including a first drive element driven by the drive signal, and a first nozzle plate including a first nozzle from which a liquid is ejected by driving the first drive element, wherein the first substrate includes a first face and a second face, wherein the drive signal output circuit is provided on the first face, and wherein a shortest distance between the first nozzle plate and the second face is shorter than a shortest distance between the first nozzle plate and the first face.

7 Claims, 15 Drawing Sheets

| [SIH, SIL] | | [1, 1] ( LD ) | [1, 0] ( MD ) | [0, 1] ( SD ) | [0, 0] ( ND ) |
|---|---|---|---|---|---|
| S1 | T1 | H | H | H | L |
| | T2 | H | L | L | L |
| S2 | T1 | L | L | L | H |
| | T2 | L | H | L | L |

LIQUID EJECTION APPARATUS AND HEAD UNIT

The present application is based on, and claims priority from JP Application Serial Number 2020-126245, filed Jul. 27, 2020, the disclosure of which is hereby incorporated by reference herein in its entirety.

BACKGROUND

1. Technical Field

The present disclosure relates to a liquid ejection apparatus and a head unit.

2. Related Art

An ink jet printer that prints an image or a document on a medium by ejecting the ink as a liquid is known in which a piezoelectric element such as a piezo element is used. The piezoelectric element is provided corresponding to each of the plurality of nozzles in the head unit. A predetermined amount of ink is ejected from the corresponding nozzle at predetermined timing by driving each of the piezoelectric elements in accordance with the drive signal. As a result, dots are formed on the medium. Such a piezoelectric element is a capacitive load such as a capacitor when viewed electrically. For this reason, it is required to supply a sufficient current to operate the piezoelectric element corresponding to each nozzle, and an ink jet printer or the like includes a drive signal output circuit having, for example, an amplifier circuit or the like that outputs a drive signal capable of supplying a sufficient current for operating the piezoelectric element.

JP-A-2016-112694 discloses a printing apparatus (liquid ejection apparatus) including a liquid ejection module (head unit) including a liquid ejection head including a piezoelectric element and a nozzle that ejects the ink, and a drive substrate includes a drive circuit that generates and amplifies a drive signal supplied to the liquid ejection head of the liquid ejection module.

In recent years, the liquid ejection apparatus such as an ink jet printer is required to further improve the ejection accuracy of the ink ejected from nozzle. In order to meet the demand for further improvement in ink ejection accuracy, further improvement in accuracy of the drive signal supplied to the piezoelectric element is required. One way to improve the accuracy of the drive signal is to shorten the propagation path through which the drive signal is supplied to the piezoelectric element. However, in order to shorten the propagation path through which the drive signal is supplied to the piezoelectric element, it is required to install the drive signal output circuit in the vicinity of the liquid ejection head including the piezoelectric element. As a result, the heat generated in the drive signal output circuit may be transferred to the liquid ejection head and affect the ejection characteristics of the ink ejected from the liquid ejection head.

However, in JP-A-2016-112694, there is no description about the arrangement of the drive circuit substrate including the drive circuit and the liquid ejection head. For this reason, the printing apparatus described in JP-A-2016-112694 has room for improvement from the viewpoint of further improving the ink ejection accuracy and reducing the effect of heat generated in the drive signal output circuit on the ink ejection characteristics.

SUMMARY

According to an aspect of the present disclosure, a liquid ejection apparatus includes a head unit that ejects a liquid, and a control unit that controls an operation of the head unit, wherein the head unit includes a drive signal output circuit that outputs a drive signal, a first substrate on which the drive signal output circuit is provided, and a first ejection head including a first drive element driven by the drive signal, a first switching circuit that switches whether to supply the drive signal to the first drive element, and a first nozzle plate including a first nozzle from which a liquid is ejected by driving the first drive element, wherein the first substrate includes a first face and a second face, wherein the drive signal output circuit is provided on the first face, and wherein a shortest distance between the first nozzle plate and the second face is shorter than a shortest distance between the first nozzle plate and the first face.

According to an aspect of the present disclosure, a head unit includes a drive signal output circuit that outputs a drive signal, a first substrate on which the drive signal output circuit is provided, and a first ejection head including a first drive element driven by the drive signal, a first selection circuit that selects whether to supply the drive signal to the drive element, and a first nozzle plate including a first nozzle from which a liquid is ejected by driving the drive element, wherein the first substrate includes a first face and a second face, wherein the drive signal output circuit is provided on the first face, and wherein a shortest distance between the first nozzle plate and the second face is shorter than a shortest distance between the first nozzle plate and the first face.

DESCRIPTION OF EXEMPLARY EMBODIMENTS

Hereinafter, preferred embodiments of the present disclosure will be described with reference to the drawings. The drawings used are for convenience of explanation. The embodiments described below do not unduly limit the details of the present disclosure described in the claims. In addition, all of the configurations described below are not necessarily essential components of the disclosure.

1. Functional Configuration of Liquid Ejection Apparatus

Figure 1A:
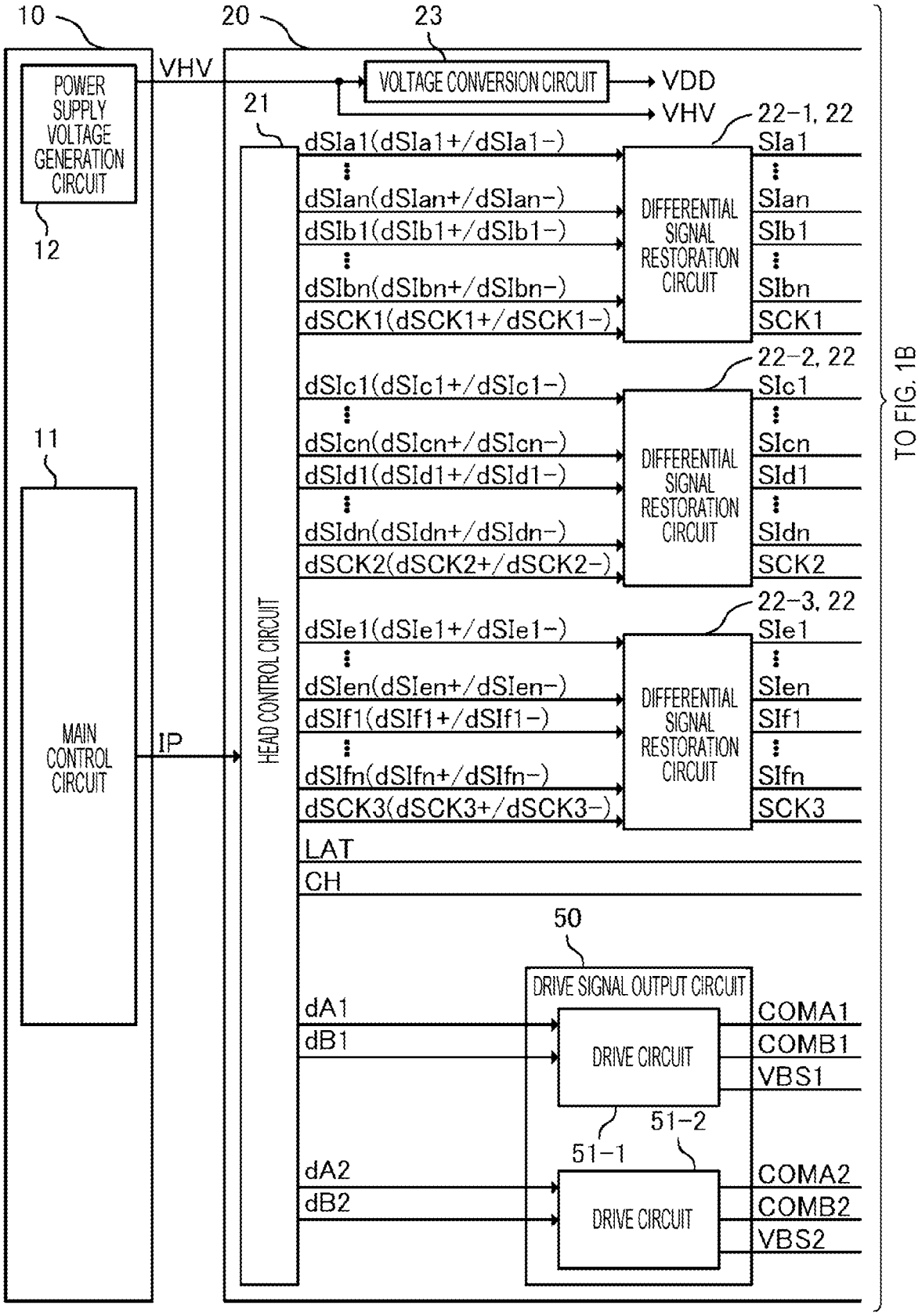
FIGS. 1A and 1B are a diagram illustrating a functional configuration of a liquid ejection apparatus.
Figure 1B:
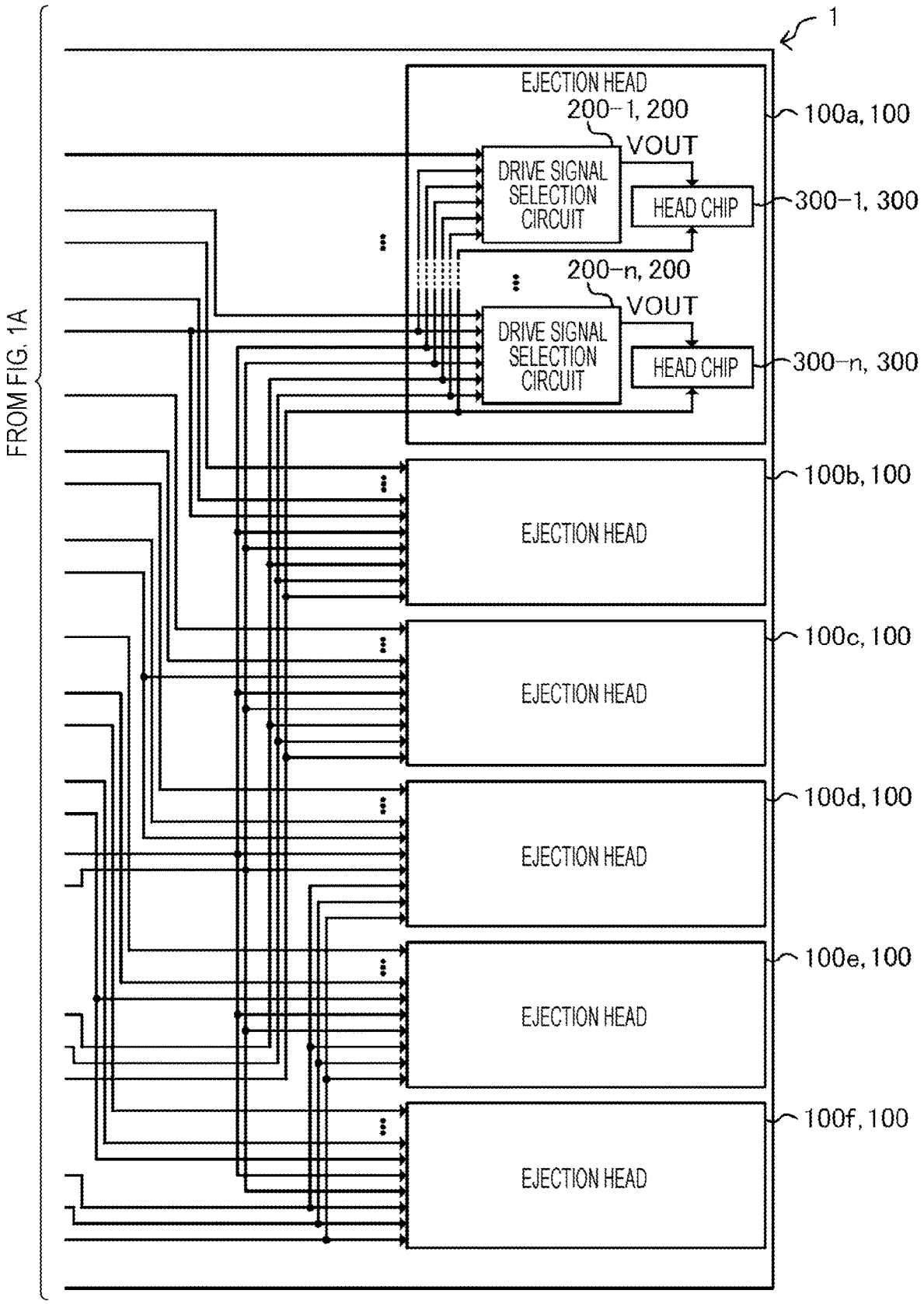

First, the functional configuration of a liquid ejection apparatus 1 in the present embodiment will be described with reference to FIGS. 1A and 1B. The liquid ejection apparatus 1 in the present embodiment will be described by taking as an example an ink jet printer that forms a desired image on a medium by ejecting the ink as an example of a liquid onto a medium. The liquid ejection apparatus 1 receives image data from a computer or the like (not illustrated) by wired communication or radio communication, and forms an image on a medium based on the received image data. FIGS. 1A and 1B are a diagram illustrating a functional configuration of the liquid ejection apparatus 1. As illustrated in FIGS. 1A and 1B, the liquid ejection apparatus 1 includes a head unit 20 that ejects the ink and a control unit 10 that controls the operation of the head unit 20.

The control unit 10 includes a main control circuit 11 and a power supply voltage generation circuit 12.

A commercial voltage, which is an AC voltage, is input to the power supply voltage generation circuit 12 from a commercial AC power supply (not illustrated) provided outside the liquid ejection apparatus 1. Then, the power supply voltage generation circuit 12 generates and output a voltage VHV, which is a DC voltage, for example, having a voltage value of 42 V, based on the input commercial voltage. That is, the power supply voltage generation circuit 12 is an AC/DC converter that converts an AC voltage into a DC voltage, and includes, for example, a flyback circuit and the like. Then, the voltage VHV generated by the power supply voltage generation circuit 12 is supplied as a power supply voltage to each unit of the liquid ejection apparatus 1 including the control unit 10 and the head unit 20. Here, the power supply voltage generation circuit 12 may generate, in addition to the voltage VHV, a DC voltage having each of a plurality of voltage values supplied to each unit of the liquid ejection apparatus 1 including the control unit 10 and the head unit 20, and may output the generated DC voltage to each corresponding configuration of the liquid ejection apparatus 1.

An image signal is input to the main control circuit 11 from an external device such as a host computer provided outside the liquid ejection apparatus 1 via an interface circuit (not illustrated). Then, the main control circuit 11 performs a predetermined image process on the input image signal, and then outputs the image processed signal to the head unit 20 as an image information signal IP. The image information signal IP output from the main control circuit 11 may be, for example, an electric signal such as a differential signal or an optical signal for optical communication.

Here, examples of the image process executed by the main control circuit 11 include a color conversion process of converting the input image signal into red, green, and blue color information and then converting the converted image signal into the color information corresponding to the color of the ink ejected from the liquid ejection apparatus 1, and a halftone process of binarizing the color information that has undergone the color conversion process. The image process executed by the main control circuit 11 is not limited to the color conversion process and the halftone process described above.

The main control circuit 11 as described above is one or a plurality of semiconductor devices having a plurality of functions, and is configured as, for example, a system on a chip (SoC).

The head unit 20 includes a head control circuit 21, differential signal restoration circuits 22-1 to 22-3, a voltage conversion circuit 23, a drive signal output circuit 50, and ejection heads 100*a* to 100*f*.

The voltage VHV is input to the voltage conversion circuit 23. Then, the voltage conversion circuit 23 steps up or steps down the voltage value of the input voltage VHV to a DC voltage having a predetermined voltage value such as 3.3 V or 5 V to output the generated DC voltage as a voltage VDD. The voltage conversion circuit 23 may output a plurality of DC voltages having different voltage values as the voltage VDD. That is, the voltage VDD output by the voltage conversion circuit 23 is not limited to one DC voltage.

The head control circuit 21 outputs a control signal for controlling each unit of the head unit 20 based on the image information signal IP input from the main control circuit 11. Specifically, the head control circuit 21 generates, based on the image information signal IP, differential signals dSCK1 to dSCK3, which are obtained by converting the control signal for controlling the ejection of the ink from the ejection head 100 into a differential signal, and differential signals dSIa1 to dSIan, dSIb1 to dSIbn, dSIc1 to dSIcn, dSId1 to dSIdn, dSIe1 to dSIen, and dSIf1 to dSIfn to output them to the differential signal restoration circuits 22-1 to 22-3.

The differential signal restoration circuits 22-1 to 22-3 restores corresponding clock signals SCK1 to SCK3 and print data signals SIa1 to SIan, SIb1 to SIbn, SIc1 to SIcn, SId1 to SIdn, SIe1 to SIen, and SIf1 to SIfn from the input differential signals dSCK1 to dSCK3, and the input differential signals dSIa1 to dSIan, dSIb1 to dSIbn, dSIc1 to dSIcn, dSId1 to dSIdn, dSIe1 to dSIen, and dSIf1 to dSIfn output them to the ejection heads 100*a* to 100*f*.

Specifically, the head control circuit 21 generates the differential signal dSCK1 including a pair of signals dSCK1+ and dSCK1−, the differential signals dSIa1 to dSIan including a pair of signals dSIa1+ to dSIan+ and dSIa1− to dSIan−, and the differential signals dSIb1 to dSIbn including a pair of signals dSIb1+ to dSIbn+ and dSIb1− to dSIbn− to output them to the differential signal restoration circuit 22-1. The differential signal restoration circuit 22-1 restores the input differential signal dSCK1 to generate the clock signal SCK1, which is the corresponding single-ended signal, to output the generated clock signal SCK1 to the ejection heads 100*a* and 100*b*, restores the differential signals dSIa1 to dSIan to generate the print data signals SIa1 to SIan, which are the corresponding single-ended signals, to output the generated print data signals SIa1 to SIan to the ejection head 100*a*, and restores the differential signals dSIb1 to dSIbn to generate the print data signals SIb1 to SIbn, which are the corresponding single-ended signals, to output the generated print data signals SIb1 to SIbn to the ejection head 100*b*.

Similarly, the head control circuit 21 generates a differential signal dSCK2 including a pair of signals dSCK2+ and dSCK2−, differential signals dSIc1 to dSIcn including a pair of signals dSIc1+ to dSIcn+ and dSIc1− to dSIcn−, and differential signals dSId1 to dSIdn including a pair of signals dSId1+ to dSIdn+ and dSId1− to dSIdn− ared to output them to a differential signal restoration circuit 22-2. The differential signal restoration circuit 22-2 restores the input differential signal dSCK2 to generate the clock signal SCK2, which is the corresponding single-ended signal, to output the generated clock signal SCK2 to the ejection heads 100*c* and 100*d*, restores the differential signals dSIc1 to dSIcn to generate the print data signals SIc1 to SIcn, which are the corresponding single-ended signals, to output the generated print data signals SIc1 to SIcn to the ejection head 100*c*, and restores the differential signals dSId1 to dSIdn to generate the print data signals SId1 to SIdn, which are the corresponding single-ended signals, to output the generated print data signals SId1 to SIdn to the ejection head 100*d*.

Similarly, the head control circuit 21 generates the differential signal dSCK3 including a pair of signals dSCK3+ and dSCK3−, the differential signals dSIe1 to dSIen including a pair of signals dSIe1+ to dSIen+ and dSIe1− to dSIen−, and the differential signals dSIf1 to dSIfn including a pair of signals dSIf1+ to dSIfn+ and dSIf1− to dSIfn− to output them to the differential signal restoration circuit 22-3. The differential signal restoration circuit 22-3 restores the input differential signal dSCK3 to generate the clock signal SCK3, which is the corresponding single-ended signal, to output the generated clock signal SCK3 to the ejection heads 100*e* and 100*f*, restores the differential signals dSIe1 to dSIen to generate the print data signals SIe1 to SIen, which are the corresponding single-ended signals, to output the generated print data signals SIe1 to SIen to the ejection head 100*e*, and restores the differential signals dSIf1 to dSIfn to generate the print data signals SIf1 to SIfn, which are the corresponding single-ended signals, to output the generated print data signals SIf1 to SIfn to the ejection head 100*f*.

Here, the differential signals dSCK1 to dSCK3 and the differential signals dSIa1 to dSIan, dSIb1 to dSIbn, dSIc1 to dSIcn, dSId1 to dSIdn, dSIe1 to dSIen, and dSIf1 to dSIfn output from the head control circuit 21 may be, for example, a differential signal of a low voltage differential signaling (LVDS) transfer method, or may be a differential signal of various high-speed transfer methods such as a low voltage positive emitter coupled logic (LVPECL) and a current mode logic (CML) other than LVDS.

The head unit 20 may include a differential signal generation circuit that generates a differential signal, the head control circuit 21 may output base control signals oSCK1 to oSCK3, which are the basis of differential signals dSCK1 to dSCK3, and the base control signals oSIa1 to oSIan, oSIb1 to oSIbn, oSIc1 to oSIcn, oSId1 to dSIdn, dSIe1 to dSIen, and dSIf1 to dSIfn, which are the bais of the differential signals dSIa1 to dSIan, dSIb1 to dSIbn, dSIc1 to dSIcn, dSId1 to dSIdn, dSIe1 to dSIen, and dSIf1 to dSIfn to the differential signal generation circuit, and the differential signal generation circuit may generate the differential signals dSCK1 to dSCK3 and the differential signals dSIa1 to dSIan, dSIb1 to dSIbn, dSIc1 to dSIcn, dSId1 to dSIdn, dSIe1 to dSIen, and dSIf1 to dSIfn based on the input base control signals oSCK1 to oSCK3 and the base control signal oSIa1 to oSIan, oSIb1 to oSIbn, oSIc1 to oSIcn, oSId1 to oSIdn, oSIe1 to oSIen, and oSIf1 to oSIfn to output them to each of the differential signal restoration circuits 22-1 to 22-3.

Further, the head control circuit 21 generates, based on the image information signal IP input from the main control circuit 11, a latch signal LAT and a change signal CH as control signals for controlling the timing of ejecting the ink from the ejection heads 100*a* to 100*d* to output the generated latch signal LAT and change signal CH to the ejection heads 100*a* to 100*d*.

Further, the head control circuit 21 generates, based on the image information signal IP input from the main control circuit 11, base drive signals dA1, dB1, dA2, and dB2, which are the basis of drive signals COMA1, COMA2, COMB1, and COMB2 that drive the ejection heads 100*a* to 100*d* to output the generated base drive signals dA1, dB1, dA2, and dB2 to the drive signal output circuit 50.

The drive signal output circuit 50 includes the drive circuits 51-1 and 51-2. The base drive signals dA1 and dB1 are input to the drive circuit 51-1. A drive circuit 51-1 converts the input base drive signal dA1 into an analog signal and then class D amplifies the converted analog signal based on voltage VHV to generate the drive signal COMA1 to output the generated drive signal COMA1 to the ejection heads 100*a*, 100*b*, and 100*c*. The drive circuit 51-1 converts the input base drive signal dB1 into an analog signal and then class D amplifies the converted analog signal based on voltage VHV to generate the drive signal COMB1 to output the generated drive signal COMB1 to the ejection heads 100*a*, 100*b*, and 100*c*. Further, the drive circuit 51-1 steps up or steps down the voltage VDD to generate a reference voltage signal VBS1, which is a reference potential when the ink is ejected from the ejection heads 100*a*, 100*b*, and 100*c*, output the generated reference voltage signal VBS1 to the ejection heads 100*a*, 100*b*, and 100*c*. That is, the drive circuit 51-1 includes two class D amplifier circuits that generate the drive signals COMA1 and COMB1 and a step-down circuit or a step-up circuit that generates the reference voltage signal VBS1.

Further, the base drive signals dA2 and dB2 are input to the drive circuit 51-2. The drive circuit 51-2 converts the input base drive signal dA2 into an analog signal and then class D amplifies the converted analog signal based on voltage VHV to generate the drive signal COMA2 to output the generated drive signal COMA2 to the ejection heads 100*d*, 100*e*, and 100*f*. Further, the drive circuit 51-2 converts the input base drive signal dB2 into an analog signal and then class D amplifies the converted analog signal based on voltage VHV to generate the drive signal COMB2 to output the generated drive signal COMB1 to the ejection heads 100*d*, 100*e*, and 100*f*. Further, the drive circuit 51-2 steps up or steps down the voltage VDD to generate a reference voltage signal VBS2, which is a reference potential when the ink is ejected from the ejection heads 100*d*, 100*e*, and 100*f*, output the generated reference voltage signal VBS2 to the ejection heads 100*d*, 100*e*, and 100*f*. That is, the drive circuit 51-2 includes two class D amplifier circuits that generate the drive signals COMA2 and COMB2, and a step-down circuit or a step-up circuit that generates the reference voltage signal VBS2.

Here, in the present embodiment, description is made in which the drive circuit 51-1 outputs the drive signals COMA1 and COMB1 and the reference voltage signal VBS1 to the ejection heads 100*a*, 100*b*, and 100*c*, and the drive circuit 51-2 outputs the drive signals COMA2 and COMB2 and the reference voltage signal VBS2 to the ejection heads 100*d*, 100*e*, and 100*f*, but the present disclosure is not limited to this. For example, the drive signals COMA1 and COMB1 and the reference voltage signal VBS1 output by the drive circuit 51-1, and the drive signals COMA2 and COMB2 and the reference voltage signal VBS2 output by the drive circuit 51-2 may be input in common to each of the ejection heads 100*a* to 100*f*, or further, the drive signal output circuit 50 may include a drive circuit 51-3 that generates drive signals COMA3 and COMB3, and a reference voltage signal VBS3, the drive circuit 51-1 may output the drive signals COMA1 and COMB1 and the reference voltage signal VBS1 to the ejection heads 100*a* and 100*b*, the drive circuit 51-2 may output the drive signals COMA2 and COMB2 and the reference voltage signal VBS2 to the ejection heads 100*c* and 100*d*, and the drive circuit 51-3 may output the drive signals COMA3 and COMB3 and the reference voltage signal VBS3 to the ejection heads 100*e* and 100*f*. Further, a common reference voltage signal VBS may be supplied to the ejection heads 100*a* to 100*f*. The drive circuits 51-1 and 51-2 may amplify the analog signals corresponding to the input base drive signals dA1, dB1, dA2, and dB2 based on the voltage VHV, and may be configured to include a class A amplifier circuit, a class B amplifier circuit, or a class AB amplifier circuit.

The ejection head 100*a* includes drive signal selection circuits 200-1 to 200-*n* and head chips 300-1 to 300-*n* corresponding to the respective drive signal selection circuits 200-1 to 200-*n*.

The print data signal SIa1, the clock signal SCK1, the latch signal LAT, the change signal CH, and the drive signals COMA1 and COMB1 are input to the drive signal selection circuit 200-1 included in the ejection head 100*a*. The drive signal selection circuit 200-1 included in the ejection head 100*a* selects or does not select, based on the print data signal SIa1, the waveforms of the drive signals COMA1 and COMB1 at the timing specified by the latch signal LAT and the change signal CH to generate a drive signal VOUT to supply the generated drive signal VOUT to the head chip 300-1 included in the ejection head 100*a*. As a result, a piezoelectric element 60 described later included in the head chip 300-1 is driven, and the ink is ejected from the nozzle as the piezoelectric element 60 is driven.

Similarly, the print data signal SIan, the clock signal SCK1, the latch signal LAT, the change signal CH, and the drive signals COMA1 and COMB1 are input to the drive signal selection circuit 200-*n* included in the ejection head 100*a*. The drive signal selection circuit 200-*n* included in the ejection head 100*a* selects or does not select, based on the print data signal SIan, the waveforms of the drive signals COMA1 and COMB1 at the timing specified by the latch signal LAT and the change signal CH to generate a drive signal VOUT to supply the generated drive signal VOUT to the head chip 300-*n* included in the ejection head 100*a*. As a result, the piezoelectric element 60 described later included in the head chip 300-*n* is driven, and the ink is ejected from the nozzle as the piezoelectric element 60 is driven.

That is, each of the drive signal selection circuits 200-1 to 200-*n* switches whether to supply the drive signals COMA and COMB as the drive signals VOUT to the piezoelectric elements 60 included in the corresponding head chips 300-1 to 300-*n*. Here, the ejection head 100*a* and the ejection heads 100*b* to 100*f* differ only in the input signal, and the configuration and operation thereof are the same. Therefore, the description of the configuration and operation of the ejection heads 100*b* to 100*f* will be omitted.

Further, in the following description, when it is not necessary to particularly distinguish the ejection heads 100*a* to 100*f*, they may be simply referred to as the ejection head 100. Further, the drive signal selection circuits 200-1 to 200-*n* included in the ejection head 100 have the same configuration, and the head chips 300-1 to 300-*n* have the same configuration. Therefore, when it is not necessary to distinguish the drive signal selection circuits 200-1 to 200-*n*, they are simply referred to as a drive signal selection circuit 200, and the drive signal selection circuit 200 will be described as supplying the drive signal VOUT to a head chip 300. In this case, description is made in which the print data signal SI, the clock signal SCK, the latch signal LAT, the change signal CH, and the drive signals COMA and COMB are input to the drive signal selection circuit 200.

2. Configuration and Operation of Drive Signal Selection Circuit

Next, the configuration and operation of the drive signal selection circuit 200 will be described. In explaining the configuration and operation of the drive signal selection circuit 200, first, an example of the waveforms of the drive signals COMA and COMB input to the drive signal selection circuit 200 and an example of the waveform of the drive signal VOUT output from the drive signal selection circuit 200 will be described.

Figure 2:
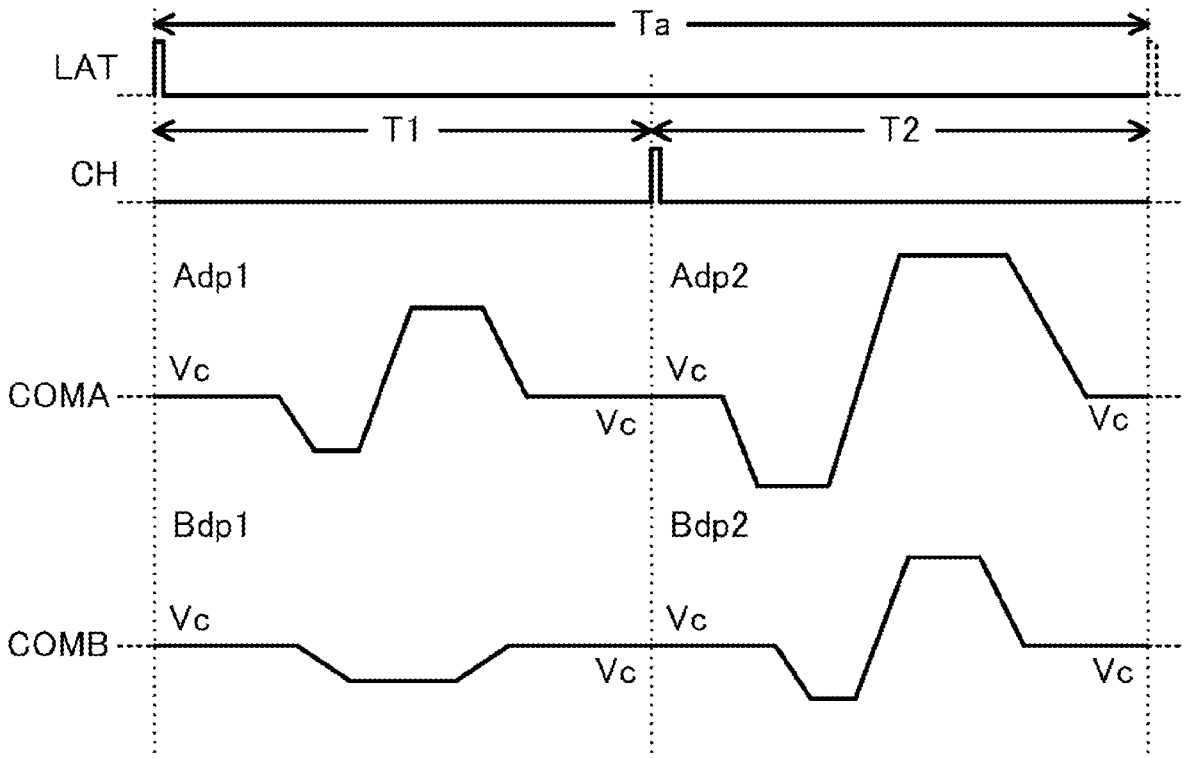
FIG. 2 is a diagram illustrating an example of waveforms of drive signals COMA and COMB.

FIG. 2 is a diagram illustrating an example of waveforms of drive signals COMA and COMB. As illustrated in FIG. 2, the drive signal COMA includes a waveform in which a trapezoidal waveform Adp1 disposed in a period T1 from the rise of the latch signal LAT to the rise of the change signal CH, and a trapezoidal waveform Adp2 disposed in a period T2 from the rise of the change signal CH to the rise of the latch signal LAT are made to be continuous. When the trapezoidal waveform Adp1 is supplied to the head chip 300, a small amount of ink is ejected from the corresponding nozzle of the head chip 300, and when the trapezoidal waveform Adp2 is supplied to the head chip 300, a medium amount of ink, which is more than a small amount, is ejected from the corresponding nozzle of the head chip 300.

Further, as illustrated in FIG. 2, the drive signal COMB includes a waveform in which a trapezoidal waveform Bdp1 disposed in the period T1 and a trapezoidal waveform Bdp2 disposed in the period T2 are made to be continuous. When the trapezoidal waveform Bdp1 is supplied to the head chip 300, no ink is ejected from the corresponding nozzle of the head chip 300. The trapezoidal waveform Bdp1 is a waveform for slightly vibrating the ink in the vicinity of the open hole of the nozzle to prevent an increase in ink viscosity. Further, when the trapezoidal waveform Bdp2 is supplied to the head chip 300, a small amount of ink is ejected from the corresponding nozzle of the head chip 300, as in a case where the trapezoidal waveform Adp1 is supplied.

Here, as illustrated in FIG. 2, the voltage values at the start timing and the end timing of the trapezoidal waveforms Adp1, Adp2, Bdp1, and Bdp2 are commonly a voltage Vc. That is, each of the trapezoidal waveforms Adp1, Adp2, Bdp1, and Bdp2 is a waveform that starts at the voltage Vc and ends at the voltage Vc. A cycle Ta including the period T1 and the period T2 corresponds to a printing cycle in which a new dot is formed on the medium.

Here, in FIG. 2, the trapezoidal waveform Adp1 and the trapezoidal waveform Bdp2 are identical, but the trapezoidal waveform Adp1 and the trapezoidal waveform Bdp2 may be different. Further, the description is made assuming that a small amount of ink is ejected from the corresponding nozzle when the trapezoidal waveform Adp1 is supplied to the head chip 300, and when the trapezoidal waveform Bdp1 is supplied to the head chip 300, but the present disclosure is not limited to this. That is, the waveforms of the drive signals COMA and COMB are not limited to the waveforms illustrated in FIG. 2. Depending on the nature of the ink ejected from the nozzle of the head chip 300 and the material of the medium on which the ink lands, and the like, signals with various waveform combinations may be used. Further, the drive signal COMA1 output by the drive circuit 51-1 and the drive signal COMA2 output by the drive circuit 51-2 may have different the waveforms, and similarly, the drive signal COMB1 output by the drive circuit 51-1 and the drive signal COMB2 output by the drive circuit 51-2 may have different the waveforms.

Figure 3:
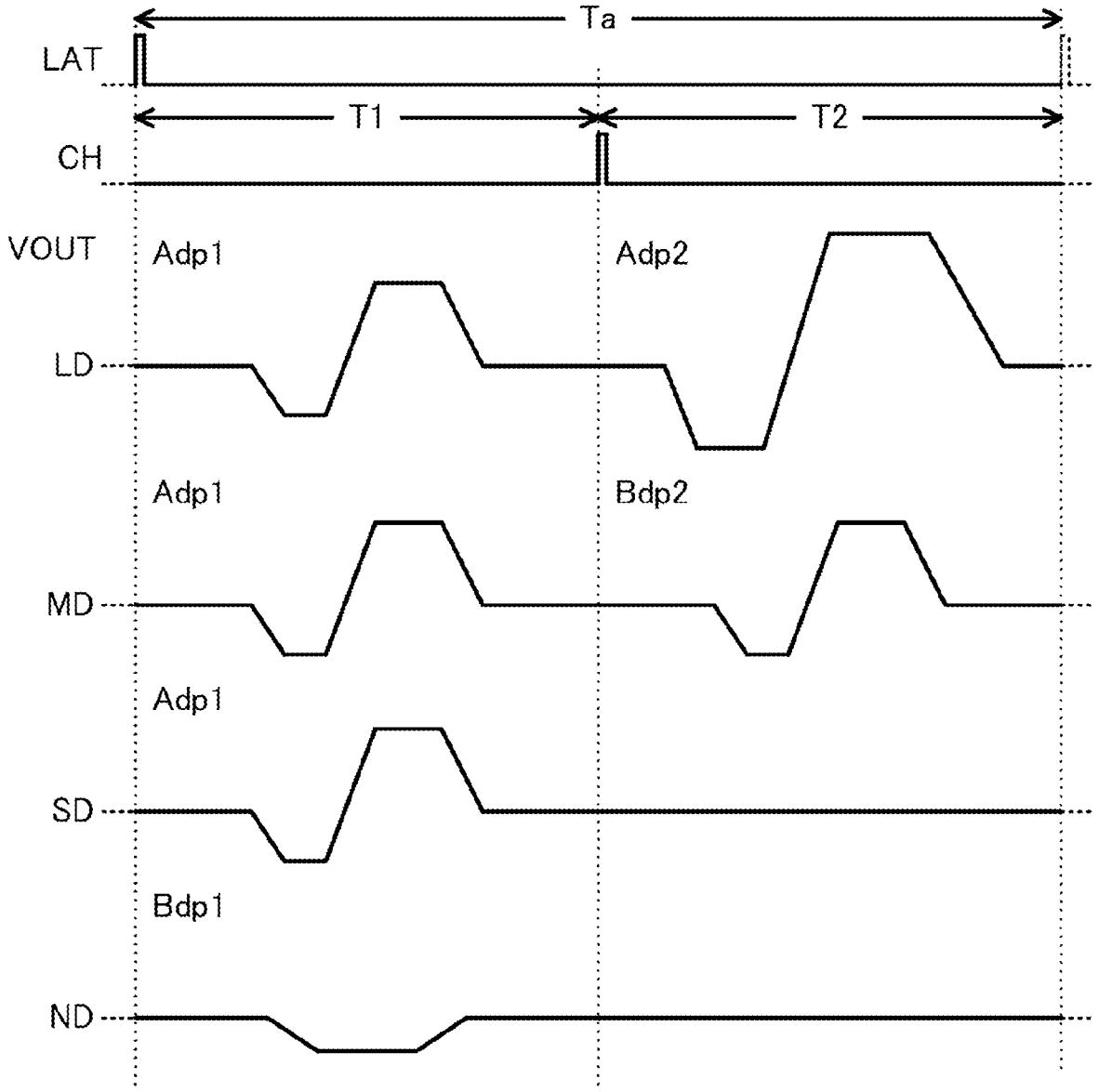
FIG. 3 is a diagram illustrating an example of waveforms of a drive signal VOUT.

FIG. 3 is a diagram illustrating an example of the waveforms of the drive signal VOUT when the sizes of the dots formed on the medium are a large dot LD, a medium dot MD, a small dot SD, and no dots recorded ND.

As illustrated in FIG. 3, the drive signal VOUT when the large dot LD is formed on the medium represents a waveform in the cycle Ta in which the trapezoidal waveform Adp1 disposed in the period T1, and the trapezoidal waveform Adp2 disposed in the period T2 are made to be continuous. When this drive signal VOUT is supplied to the head chip 300, a small amount of ink and a medium amount of ink are ejected from the corresponding nozzle. Therefore, in the cycle Ta, the respective amounts of ink land on the medium and coalesces to form the large dot LD on the medium.

The drive signal VOUT when the medium dot MD is formed on the medium represents a waveform in the cycle Ta in which the trapezoidal waveform Adp1 disposed in the period T1, and the trapezoidal waveform Bdp2 disposed in the period T2 are made to be continuous. When this drive signal VOUT is supplied to the head chip 300, a small amount of ink is ejected twice from the corresponding nozzle. Therefore, in the cycle Ta, the respective amounts of ink land on the medium and coalesce to form the medium dot MD on the medium.

The drive signal VOUT when the small dot SD is formed on the medium represents a waveform in the cycle Ta in which the trapezoidal waveform Adp1 disposed in the period T1, and a constant waveform, with the voltage Vc, disposed in the period T2 are made to be continuous. When this drive signal VOUT is supplied to the head chip 300, a small amount of ink is ejected once from the corresponding nozzle. Therefore, in the cycle Ta, when this amount of ink lands on the medium to form the small dot SD on the medium.

The drive signal VOUT corresponding to the no dots recorded ND in which no dots are formed on the medium represents a waveform in the cycle Ta in which the trapezoidal waveform Bdp1 disposed in period T1, and a constant waveform, with the voltage Vc, disposed in the period T2 are made to be continuous. When this drive signal VOUT is supplied to the head chip 300, the ink in the vicinity of the open hole of the corresponding nozzle only slightly vibrates, and no ink is ejected. Therefore, in the cycle Ta, no ink lands on the medium and no dots are formed on the medium.

Here, the waveform that is constant at the voltage Vc is a waveform with a voltage value when the voltage Vc immediately before the trapezoidal waveforms Adp1, Adp2, Bdp1, and Bdp2 is held in a case where none of the trapezoidal waveforms Adp1, Adp2, Bdp1, and Bdp2 is selected as the drive signal VOUT. Therefore, when none of the trapezoidal waveforms Adp1, Adp2, Bdp1, and Bdp2 is selected as the drive signal VOUT, the voltage Vc is supplied to the head chip 300 as the drive signal VOUT.

Figure 4:
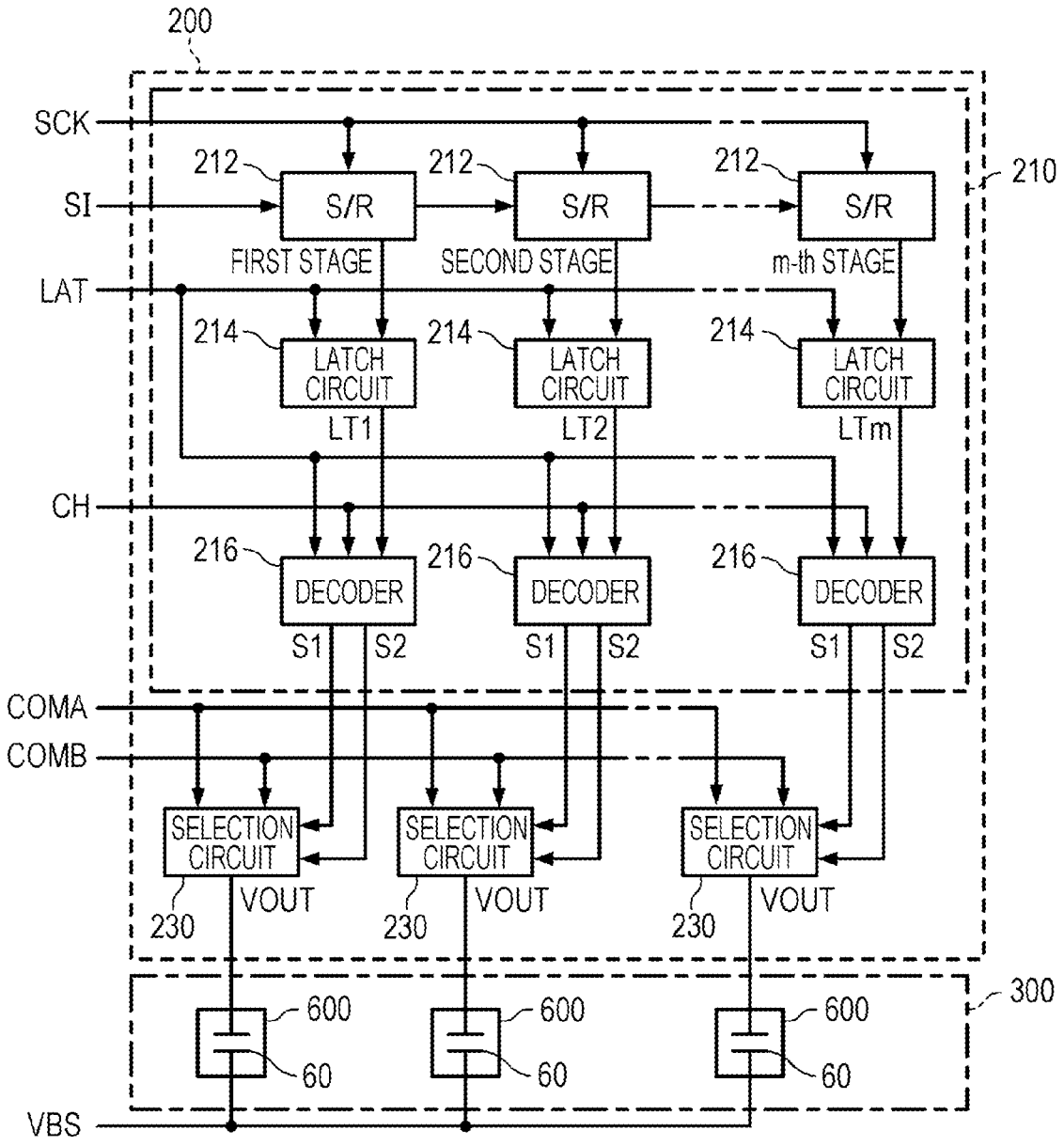
FIG. 4 is a diagram illustrating a configuration of a drive signal selection circuit.

The drive signal selection circuit 200 selects or does not select the waveforms of the drive signals COMA and COMB to generate the drive signal VOUT to output the generated drive signal VOUT to the head chip 300. FIG. 4 is a diagram illustrating the configuration of the drive signal selection circuit 200. As illustrated in FIG. 4, the drive signal selection circuit 200 includes a selection control circuit 210 and a plurality of selection circuits 230. Further, FIG. 4 illustrates an example of the head chip 300 to which the drive signal VOUT output from the drive signal selection circuit 200 is supplied. As illustrated in FIG. 4, the head chip 300 includes m ejection units 600 each having the piezoelectric element 60.

The print data signal SI, the latch signal LAT, the change signal CH, and the clock signal SCK are input to the selection control circuit 210. The selection control circuit 210 includes a set of a shift register (SIR) 212, a latch circuit 214, and a decoder 216 corresponding to each of the m ejection units 600 of the head chip 300. That is, the drive signal selection circuit 200 includes the same number of sets of the shift registers 212, the latch circuits 214, and the decoders 216 as the m ejection units 600 of the head chip 300.

The print data signal SI is a signal synchronized with the clock signal SCK, and is a total 2 m-bit signal including 2-bit print data [SIH, SIL] for selecting any one of the large dot LD, the medium dot MD, the small dot SD, and the no dots recorded ND for each of the m ejection units 600. The input print data signal SI is held in the shift register 212 for 2-bit print data [SIH, SIL] included in the print data signal SI corresponding to each of the m ejection units 600. Specifically, the selection control circuit 210 is configured such that the m-th stage shift registers 212 corresponding to the m ejection units 600 are cascade-coupled to each other, and the print data [SIH, SIL] input serially as the print data signal SI is sequentially transferred to the subsequent stage according to the clock signal SCK. In FIG. 4, in order to distinguish the shift registers 212, they are denoted as the first stage, the second stage, . . . , the m-th stage in order starting from the upstream shift register to which the print data signal SI is input.

The m latch circuits 214 latches the 2-bit print data [SIH, SIL] held by the respective m shift registers 212 at the rising edge of the latch signal LAT.

Figures 5, 6:
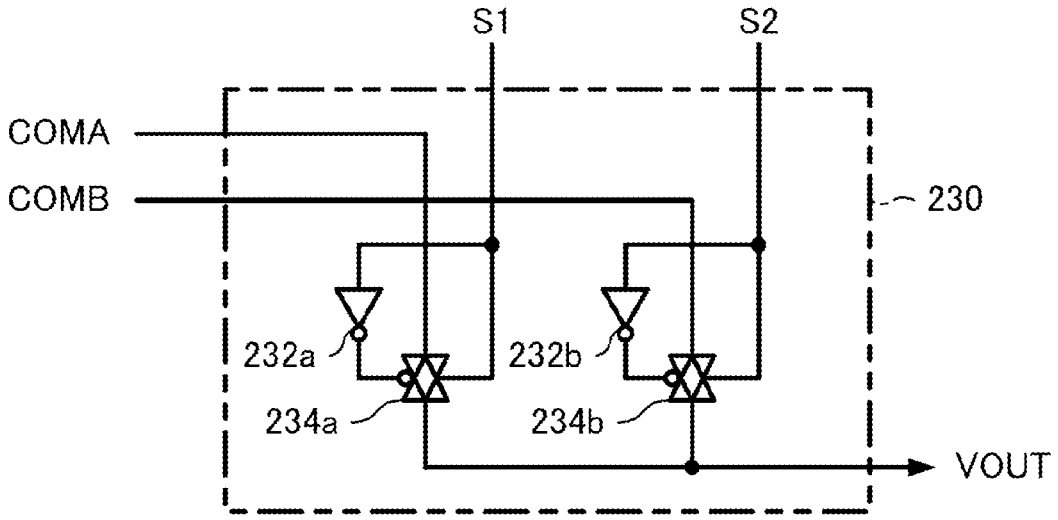
FIG. 5 is a diagram illustrating the decoding contents in a decoder.
FIG. 6 is a diagram illustrating a configuration of a selection circuit corresponding to one ejection unit.

FIG. 5 is a diagram illustrating the decoding contents in the decoder 216. The decoder 216 outputs selection signals S1 and S2 according to the latched 2-bit print data [SIH, SIL]. For example, when the 2-bit print data [SIH, SIL] is [1, 0], the decoder 216 outputs the logic level of the selection signal S1 as H and L levels in the periods T1 and T2, and the logic level of the selection signal S2 as L and H levels in the periods T1 and T2 to the selection circuit 230.

The selection circuits 230 are provided corresponding to the respective ejection units 600. That is, the number of the selection circuits 230 included in the drive signal selection circuit 200 is m, which is the same as the number of the ejection units 600. FIG. 6 is a diagram illustrating a configuration of the selection circuit 230 corresponding to one ejection unit 600. As illustrated in FIG. 6, the selection circuit 230 includes inverters 232*a* and 232*b*, which are NOT circuits, and transfer gates 234*a* and 234*b*.

The selection signal S1 is input to the non-circled positive control end of the transfer gate 234*a*, while being input to the circled negative control end of the transfer gate 234*a* after logically inverted by the inverter 232*a*. The drive signal COMA is supplied to the input end of the transfer gate 234*a*. The selection signal S2 is input to the non-circled positive control end of the transfer gate 234*b*, while being input to the circled negative control end of the transfer gate 234*b* after logically inverted by the inverter 232*b*. The drive signal COMB is supplied to the input end of the transfer gate 234*b*. The output ends of the transfer gates 234*a* and 234*b* are coupled in common and the drive signal COMA and the drive signal COMB are output as the drive signal VOUT.

Specifically, when the selection signal S1 is at H level, the transfer gate 234*a* brings the input end and the output end into a conductive state therebetween, and when the selection signal S1 is at L level, the transfer gate 234*a* brings the input end and the output end into a non-conductive state therebetween. When the selection signal S2 is at H level, the transfer gate 234*b* brings the input end and the output end into a conductive state therebetween, and when the selection signal S2 is at L level, the transfer gate 234*b* brings the input end and the output end into a non-conductive state therebetween. As described above, the selection circuit 230 selects the waveforms of the drive signals COMA and COMB based on the selection signals S1 and S2 to output the drive signal VOUT.

Figure 7:
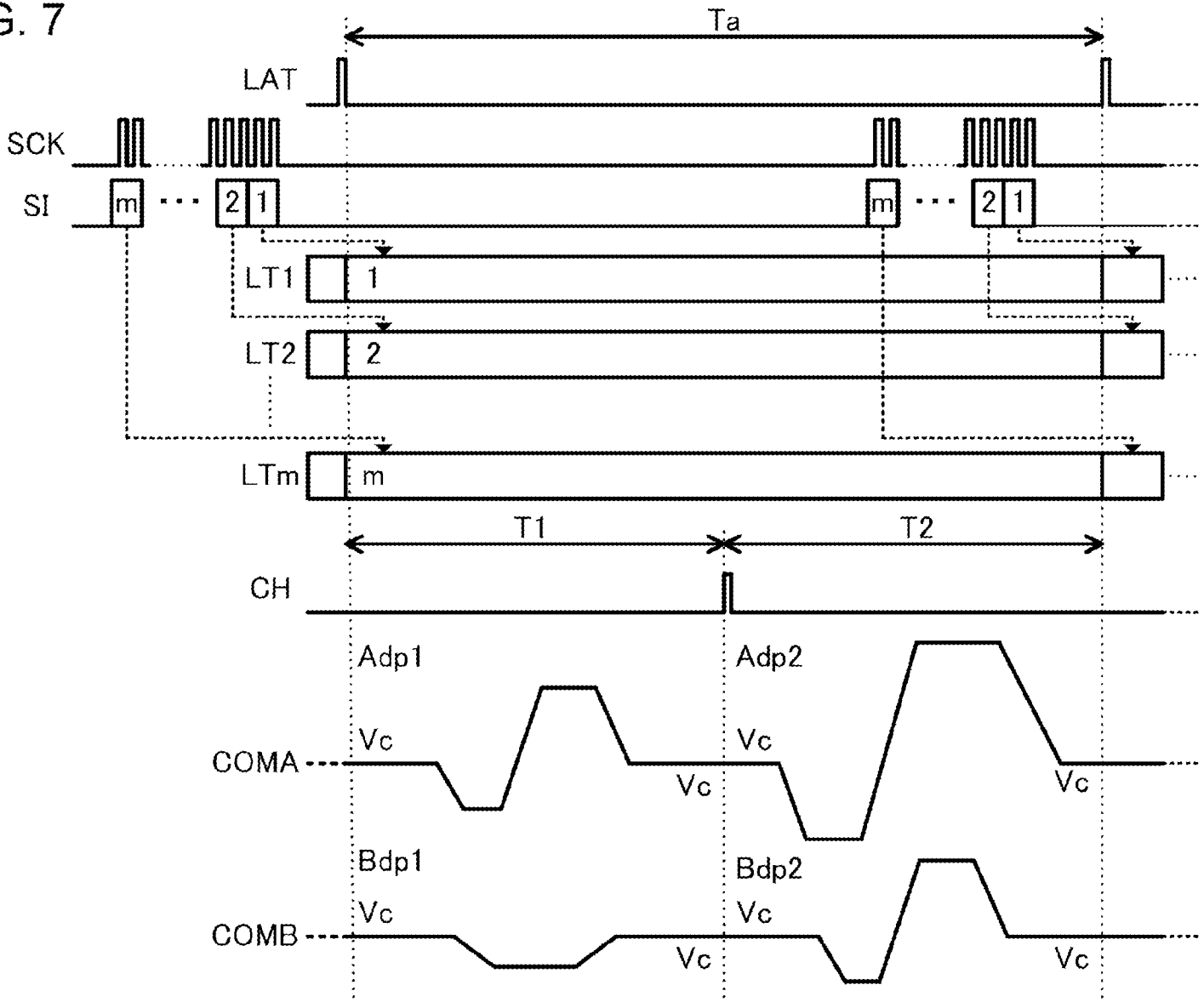
FIG. 7 is a diagram for explaining the operation of the drive signal selection circuit.

The operation of the drive signal selection circuit 200 will be described with reference to FIG. 7. FIG. 7 is a diagram for explaining the operation of the drive signal selection circuit 200. The print data [SIH, SIL] included in the print data signal SI is serially input in synchronization with the clock signal SCK, and is sequentially transferred to the shift registers 212 corresponding to the respective ejection units 600. When the input of the clock signal SCK stops, each shift register 212 holds 2-bit print data [SIH, SIL] corresponding to each of the m ejection units 600. The print data [SIH, SIL] included in the print data signal SI is input in the order corresponding to the ejection units 600 for the m-th stage, . . . , the second stage, and the first stage shift registers 212.

When the latch signal LAT rises, the latch circuits 214 simultaneously latches the 2-bit print data [SIH, SIL] held in the respective shift registers 212. In FIG. 7, LT1, LT2, . . . , LTm are 2-bit print data [SIH, SIL] latched by the latch circuit 214 corresponding to the shift registers 212 of the first stage, the second stage, . . . , the m-th stage.

The decoder 216 outputs the logic levels of the selection signals S1 and S2 in accordance with the contents as shown in FIG. 5 in each of the periods T1 and T2 according to a dot size defined by the latched 2-bit print data [SIH, SIL].

Specifically, when the input print data [SIH, SIL] is [1, 1], the decoder 216 sets the selection signal S1 to H and H levels in the periods T1 and T2, and sets the selection signal S2 to L and L levels in the periods T1 and T2. In this case, the selection circuit 230 selects the trapezoidal waveform Adp1 in the period T1 and selects the trapezoidal waveform Adp2 in the period T2. As a result, the drive signal VOUT corresponding to the large dot LD illustrated in FIG. 3 is generated.

When the input print data [SIH, SIL] is [1, 0], the decoder 216 sets the selection signal S1 to H and L levels in the periods T1 and T2, and sets the selection signal S2 to L and H levels in the periods T1 and T2. In this case, the selection circuit 230 selects the trapezoidal waveform Adp1 in the period T1 and selects the trapezoidal waveform Bdp2 in the period T2. As a result, the drive signal VOUT corresponding to the medium dot MD illustrated in FIG. 3 is generated.

When the input print data [SIH, SIL] is [0, 1], the decoder 216 sets the selection signal S1 to H and L levels in the periods T1 and T2, and sets the selection signal S2 to L and L levels in the periods T1 and T2. In this case, the selection circuit 230 selects the trapezoidal waveform Adp1 in the period T1, and selects none of the trapezoidal waveforms Adp2 and Bdp2 in the period T2. As a result, the drive signal VOUT corresponding to the small dot SD illustrated in FIG. 3 is generated.

When the input print data [SIH, SIL] is [0, 0], the decoder 216 sets the selection signal S1 to L and L levels in the periods T1 and T2, and sets the selection signal S2 to H and L levels in the periods T1 and T2. In this case, the selection circuit 230 selects the trapezoidal waveform Bdp1 in the period T1, and selects none of the trapezoidal waveforms Adp2 and Bdp2 in the period T2. As a result, the drive signal VOUT corresponding to the no dots recorded ND illustrated in FIG. 3 is generated.

As mentioned above, the drive signal selection circuit 200 select the waveforms of the drive signals COMA and COMB based on the print data signal SI, the latch signal LAT, the change signal CH, and the clock signal SCK to output the selected waveforms as the drive signal VOUT. The drive signal selection circuit 200 selects or does not select the waveforms of the drive signals COMA and COMB to control the size of the dot formed on the medium, and as a result, the liquid ejection apparatus 1 forms the dot with the desired size on the medium.

Here, the drive signals COMA1, COMB1, COMA2, and COMB2 output by the drive signal output circuit 50 are an example of drive signals. Further, considering that the drive signal VOUT is generated when the drive signal selection circuit 200 selects or does not select the waveforms of the drive signals COMA1, COMB1, COMA2, and COMB2, it can be said that the drive signal VOUT is also an example of the drive signal.

3. Structure of Liquid Ejection Apparatus

Figure 8:
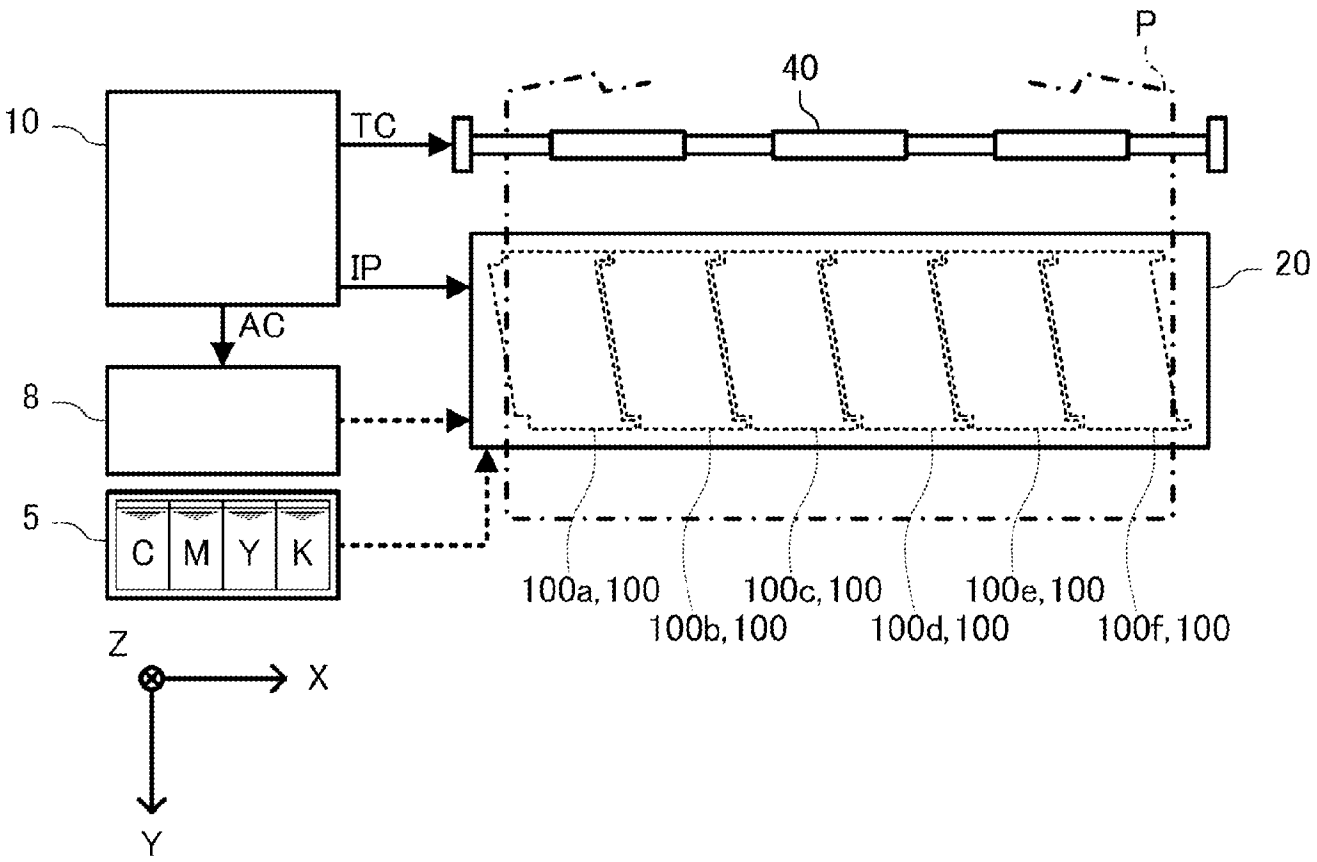
FIG. 8 is an explanatory diagram illustrating a schematic structure of a liquid ejection apparatus.

Next, the schematic structure of the liquid ejection apparatus 1 will be described. FIG. 8 is an explanatory diagram illustrating a schematic structure of the liquid ejection apparatus 1. FIG. 8 illustrates arrows indicating the X direction, the Y direction, and the Z direction that are orthogonal to each other. The Y direction corresponds to a direction in which a medium P is transported, the X direction is a direction orthogonal to the Y direction and parallel to the horizontal plane and corresponds to the main scanning direction, and the Z direction is the up and down direction of the liquid ejection apparatus 1 and corresponds to the vertical direction. Here, in the following description, when specifying the orientation along the X direction, the Y direction, and the Z direction, the distal end side of the arrow indicating the X direction may be referred to as the +X side and the starting point side may be referred to as the −X side, the distal end side of the arrow indicating the Y direction may be referred to as the +Y side and the starting point side may be referred to as the −Y side, and the distal end side of the arrow indicating the Z direction may be referred to as the +Z side and the starting point side may be referred to as the −Z side.

As illustrated in FIG. 8, the liquid ejection apparatus 1 includes a liquid container 5, a pump 8, and a transport mechanism 40 in addition to the control unit 10 and the head unit 20 described above.

As described above, the control unit 10 includes the main control circuit 11 and the power supply voltage generation circuit 12, and controls the operation of the liquid ejection apparatus 1 including the head unit 20. Further, the control unit 10 may include, in addition to the main control circuit 11 and the power supply voltage generation circuit 12, a storage circuit that stores various pieces of information, an interface circuit for communicating with a host computer provided outside the liquid ejection apparatus 1, and the like.

The control unit 10 receives an image signal input from a host computer or the like provided outside the liquid ejection apparatus 1 to perform a predetermined image process on the received image signal, and then outputs the image-processed signal as the image information signal IP to the head unit 20. Further, the control unit 10 outputs a transport control signal TC to the transport mechanism 40 that transports the medium P, thereby controlling the transport of the medium P, and outputs a pump control signal AC to the pump 8, thereby controlling the operation of the pump 8.

The liquid container 5 stores the ink to be ejected to the medium P. Specifically, the liquid container 5 includes four containers in which four different color inks of cyan C, magenta M, yellow Y, and black K are individually stored. The ink stored in the liquid container 5 is supplied to the head unit 20 via a tube or the like. The number of containers in which the ink contained in the liquid container 5 is stored is not limited to four. The container may include a container that stores the ink of a color other than Cyan C, Magenta M, Yellow Y, and Black K, or may also includes a plurality of containers for any one of cyan C, magenta M, yellow Y, and black K.

The head unit 20 includes the ejection heads 100*a* to 100*f* disposed side by side in the X direction. The ejection heads 100*a* to 100*f* included in the head unit 20 are disposed in order of the ejection head 100*a*, the ejection head 100*b*, the ejection head 100*c*, the ejection head 100*d*, the ejection head 100*e*, and the ejection head 100*f* from the −X side toward the +X side so as to have a width equal to or larger than the width of the medium P along the X direction. The head unit 20 distributes the ink supplied from the liquid container 5 to each of the ejection heads 100*a* to 100*f*, and ejects the ink supplied from the liquid container 5 toward the medium P from each of the ejection heads 100*a* to 100*f* when each of the ejection heads 100*a* to 100*f* operates based on the image information signal IP input from the control unit 10. Here, the number of ejection heads 100 included in the head unit 20 is not limited to 6, but may be 5 or less, or 7 or more.

The transport mechanism 40 transports the medium P along the Y direction based on the transport control signal TC input from the control unit 10. The transport mechanism 40 includes, for example, a roller (not illustrated) that transports the medium P, a motor that rotates the roller, and the like.

The pump 8 determines whether to supply air A to the head unit 20 and controls the amount of the air A supplied to the head unit 20 based on the pump control signal AC input from the control unit 10. The pump 8 is coupled to the head unit 20 via, for example, two tubes. Then, the pump 8 controls the opening/closing of the valve of the head unit 20 by controlling the air A flowing through each tube.

As mentioned above, in the liquid ejection apparatus 1, the control unit 10 generates the image information signal IP based on an image signal input from a host computer or the like, controls the operation of the head unit 20 by the generated image information signal IP, and controls the transport of the medium P in the transport mechanism 40 by the transport control signal TC. As a result, the liquid ejection apparatus 1 can land the ink at a desired position on the medium P, and thus can form a desired image on the medium P.

4. Head Unit Structure

Figure 9:
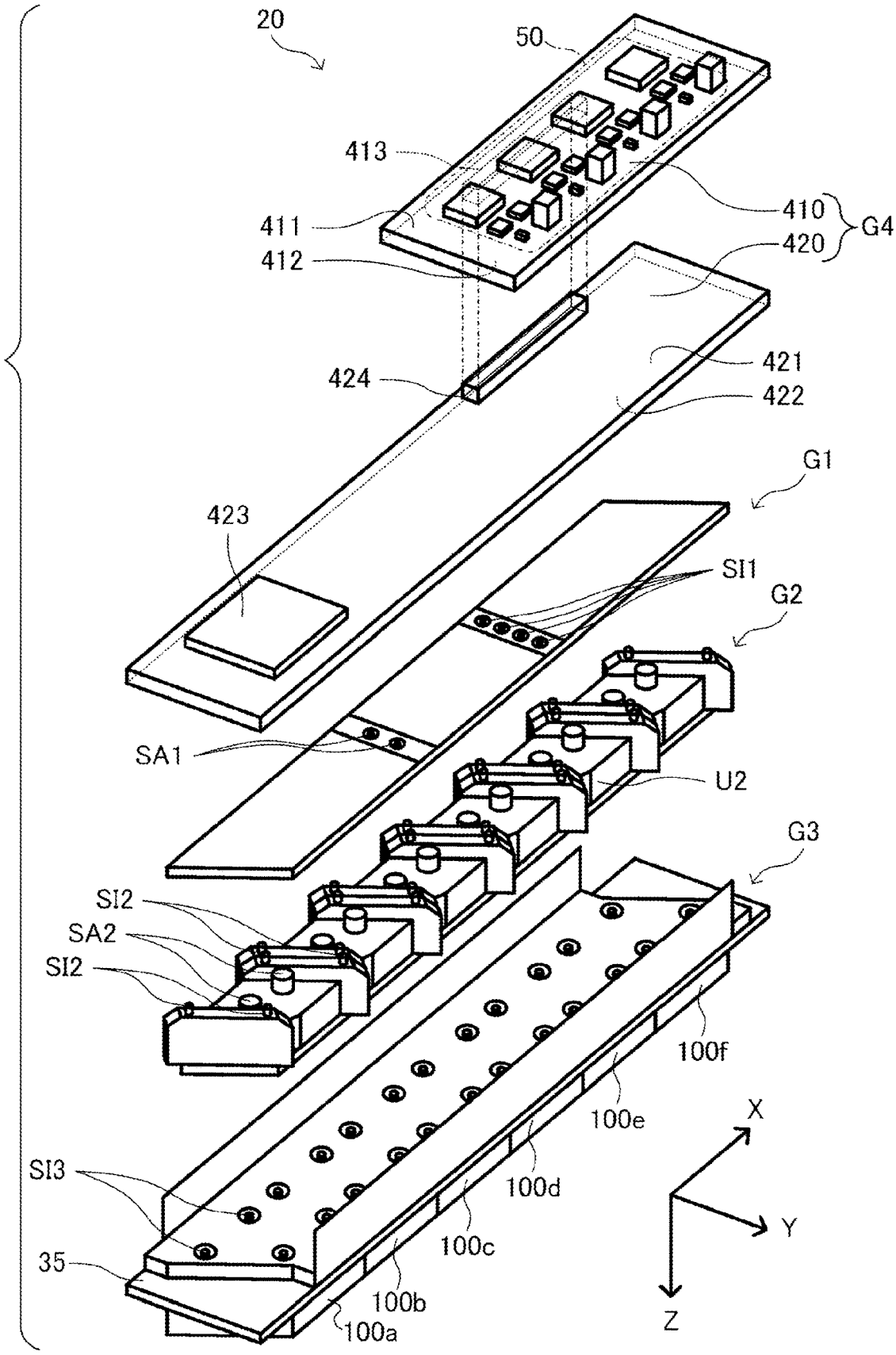
FIG. 9 is an exploded perspective view of a head unit when viewed from the −Z side.

Next, the structure of the head unit 20 will be described. FIG. 9 is an exploded perspective view when the head unit 20 is viewed from the −Z side, and FIG. 10 is an exploded perspective view when the head unit 20 is viewed from the +Z side.

Figure 10:
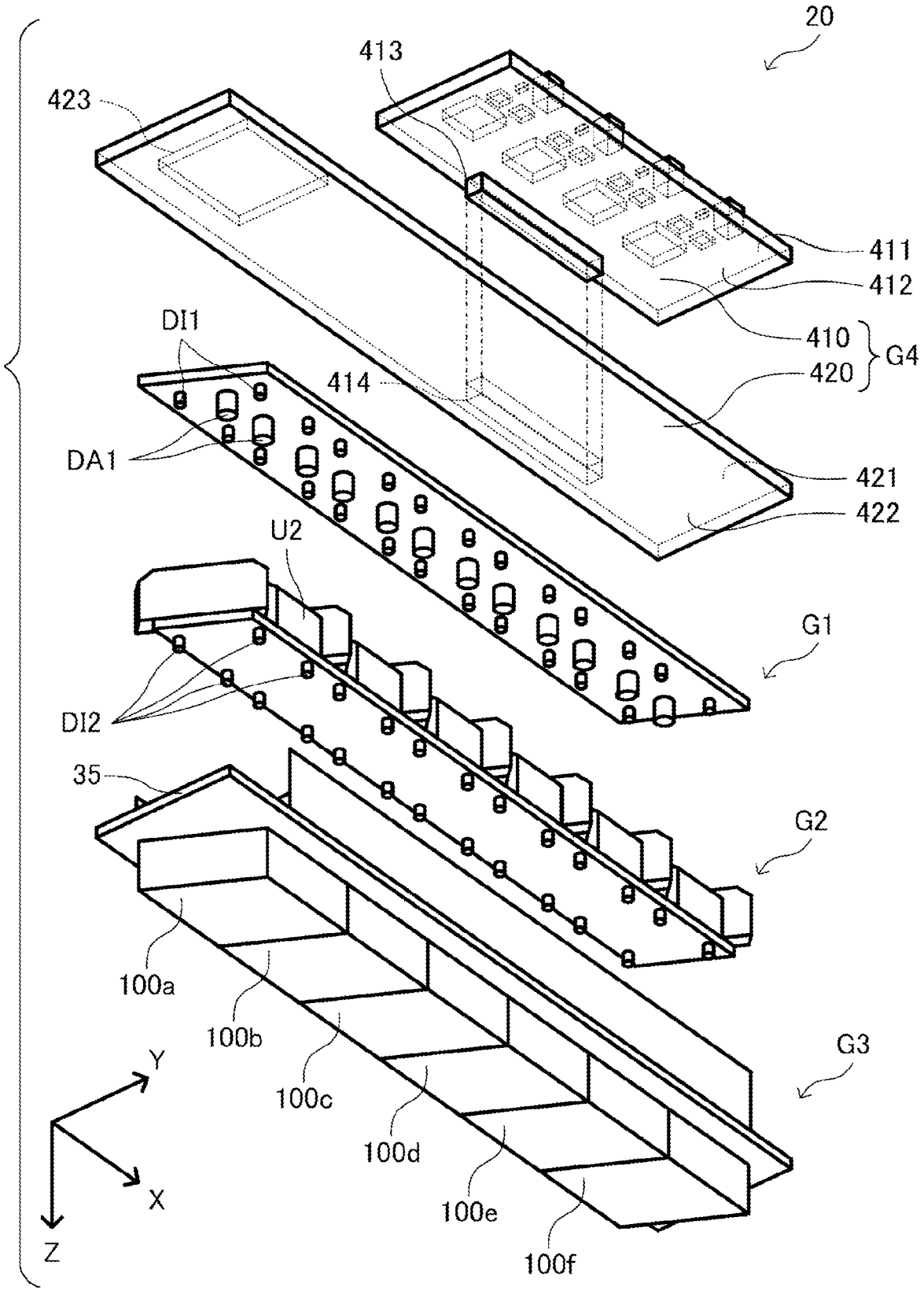
FIG. 10 is an exploded perspective view of the head unit when viewed from the +Z side.

As illustrated in FIGS. 9 and 10, the head unit 20 includes a flow path structure G1 that introduces the ink from the liquid container 5, a supply controller G2 that controls the supply of the introduced ink to the ejection head 100, a liquid ejection unit G3 including the ejection head 100 that ejects the supplied ink, and an ejection controller G4 that controls an ejection of the ink from the ejection head 100. In the head unit 20, the flow path structure G1, the supply controller G2, the liquid ejection unit G3, and the ejection controller G4 are directed from the −Z side to the +Z side along the Z direction, are disposed in the order or the ejection controller G4, the flow path structure G1, the supply controller G2 and the liquid ejection unit G3, and are fixed to each other by a fixing unit such as an adhesive or screws (not illustrated). In other words, the head unit 20 includes the supply controller G2 and the liquid ejection unit G3 that function as a flow path member that supplies the ink to the ejection head 100, and the supply controller G2 and the liquid ejection unit G3 are located between the liquid ejection unit G3 including the ejection head 100 that ejects the ink and the ejection controller G4 that controls an ejection of the ink from the ejection head 100. Here, at least one of the supply controller G2 and the liquid ejection unit G3 is an example of the flow path member.

As illustrated in FIGS. 9 and 10, the flow path structure G1 has a plurality of first liquid introduction ports SI1 corresponding to the number of colors of ink supplied to the head unit 20 and a plurality of first liquid discharge ports DI1 corresponding to the number of the ink colors and the number of the ejection heads 100. In the liquid ejection apparatus 1 of the present embodiment, the flow path structure G1 will be described as having four first liquid introduction ports SI1 and 24 first liquid discharge ports DI1. Each of the first liquid introduction ports SI1 is located on the −Z side face of the flow path structure G1 and is coupled to the liquid container 5 via a tube (not illustrated) or the like. Further, each of the first liquid discharge ports DI1 is located on the +Z side face of the flow path structure G1. A total of four ink flow paths each communicating one first liquid introduction port SI1 and six first liquid discharge ports DI1 are formed inside the flow path structure G1.

Further, the flow path structure G1 has a plurality of first air introduction ports SA1 and a plurality of first air discharge ports DA1. In the liquid ejection apparatus 1 of the present embodiment, the flow path structure G1 will be described as having two first air introduction ports SA1 and twelve first air discharge ports DA1. Each of the first air introduction ports SA1 is provided on the −Z side face of the flow path structure G1 and is coupled to the pump 8 via a tube (not illustrated). Further, each of the first air discharge ports DA1 is provided on the +Z side face of the flow path structure G1. A total of two air flow paths each of which communicates the one first air introduction port SA1 and the six first air discharge ports DA1 are formed inside the flow path structure G1.

As illustrated in FIGS. 9 and 10, the supply controller G2 has a plurality of pressure adjustment units U2 corresponding to the number of the ejection heads 100. Further, each of the plurality of pressure adjustment units U2 has a plurality of second liquid introduction ports SI2 corresponding to the number of ink colors supplied to the head unit 20, a plurality of second liquid discharge ports DI2 corresponding to the number of ink colors supplied to the head unit 20, and a plurality of second air introduction ports SA2 depending on the number of tubes coupled to the pump 8. In addition, in the liquid ejection apparatus 1 of the embodiment, description will be made in which the supply controller G2 has six pressure adjustment units U2, and each of the six pressure adjustment unit U2 has four second liquid introduction ports SI2, four second liquid discharge ports DI2, and two second air introduction ports SA2.

The second liquid introduction ports SI2 are located toward the −Z side of the pressure adjustment unit U2 and are coupled to the respective first liquid discharge ports DI1 of the flow path structure G1. That is, the supply controller G2 has the second liquid introduction ports SI2 corresponding to the respective first liquid discharge ports DI1 of the flow path structure G1. Further, the second liquid discharge ports D12 are located toward the −Z side of the pressure adjustment unit U2. An ink flow path that communicates one second liquid introduction port S12 and one second liquid discharge port D12 is formed inside the pressure adjustment unit U2. That is, a total of four ink flow paths (not illustrated) each communicating one second liquid introduction port S12 and one second liquid discharge port D12 are formed inside the pressure adjustment unit U2.

The second air introduction ports SA2 are located toward the −Z side of the pressure adjustment unit U2 and are coupled to the respective first air discharge port DA1 of the flow path structure G1. That is, the supply controller G2 has the second air introduction ports SA2 corresponding to the respective first air discharge ports DA1 of the flow path structure G1. Further, a plurality of valves that controls the supply of the ink to the ejection head 100, such as a valve that opens/closes the ink flow path and a valve that adjusts the pressure of the ink flowing through the ink flow path, are provided inside each of the pressure adjustment units U2. An air flow path communicating one second air introduction port SA2 and one valve is formed inside the pressure adjustment unit U2. That is, a total of two air flow paths (not illustrated) each communicating one second air introduction port SA2 and one valve are formed inside the pressure adjustment unit U2.

The pressure adjustment unit U2 configured as described above controls the operation of the valve provided inside thereof based on the air A supplied through an air flow path (not illustrated) communicating one second air introduction port SA2 and one valve to control the amount of ink flowing in an ink flow path (not illustrated) that communicates one second liquid introduction port SI2 and one second liquid discharge port DI2.

As illustrated in FIGS. 9 and 10, the liquid ejection unit G3 includes the ejection heads 100*a* to 100*f* and a support member 35. Each of the ejection heads 100*a* to 100*f* is located toward the +Z side of the support member 35, and is fixed to the support member 35 by a fixing unit such as an adhesive or screws (not illustrated).

The support member 35 has openings corresponding to a plurality of third liquid introduction ports SI3. Further, the plurality of third liquid introduction ports SI3 is located toward the −Z side of each of the six ejection heads 100*a* to 100*f*. The plurality of third liquid introduction ports SI3 is exposed to the −Z side of the liquid ejection unit G3 by penetrating the openings formed in the support member 35. Then, the third liquid introduction ports SI3 are coupled to the respective second liquid discharge ports DI2 of the supply controller G2. That is, the liquid ejection unit G3 has the third liquid introduction ports SI3 corresponding to the respective second liquid discharge ports DI2 of the supply controller G2. Here, in the liquid ejection apparatus 1 of the present embodiment, description will be made in which the liquid ejection unit G3 has 24 third liquid introduction ports SI3 corresponding to the respective second liquid discharge ports DI2 of the supply controller G2.

Here, the flow in which the ink is supplied from the liquid container 5 to the ejection head 100 will be described. The ink stored in the liquid container 5 is supplied to the first liquid introduction port SI1 of the flow path structure G1 via a tube (not illustrated) or the like. The ink supplied to the first liquid introduction port SI1 is distributed by an ink flow path (not illustrated) provided inside the flow path structure G1 and then is supplied to the second liquid introduction port SI2 of the pressure adjustment unit U2 via the first liquid discharge port DI1. The ink supplied to the second liquid introduction port SI2 is supplied to the third liquid introduction port SI3 of each of the six ejection heads 100 included in the liquid ejection unit G3 through the ink flow path provided inside the pressure adjustment unit U2 and the second liquid discharge port DI2. That is, the flow path structure G1 functions as a distribution flow path member that distributes and supplies the ink to each of the plurality of ejection heads 100 included in the head unit 20.

Figure 11:
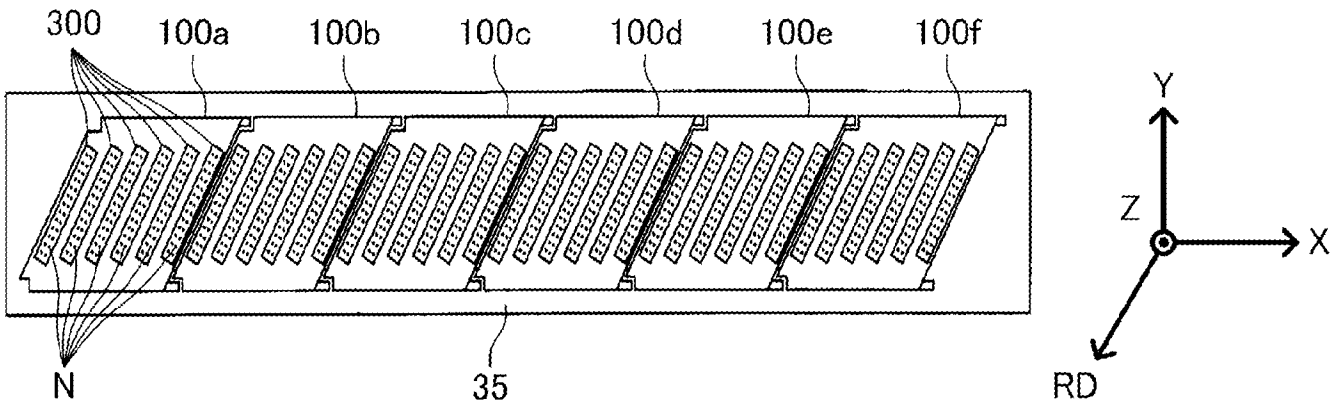
FIG. 11 is a bottom view of the head unit when viewed from the +Z side.

Here, a specific example of the arrangement of the ejection heads 100*a* to 100*f* in the head unit 20 will be described. FIG. 11 is a bottom view of the head unit 20 when viewed from the +Z side. As illustrated in FIG. 11, each of the ejection heads 100*a* to 100*f* included in the head unit 20 has six head chips 300 disposed side by side in the X direction. Although details will be described later, each head chip 300 has a plurality of nozzles N that ejects the ink. The plurality of nozzles N included in each of the head chips 300 is disposed side by side along a row direction RD in a plane perpendicular to the Z direction and formed by the X direction and the Y direction. Here, in the following description, the plurality of nozzles N disposed side by side along the row direction RD may be referred to as a nozzle row.

Here, the head chip 300 in the present embodiment has two rows of nozzle rows along the row direction RD. The nozzles N included in the ejection head 100 are divided into a group from which the ink having an ink color of cyan C is ejected, a group from which the ink having an ink color of magenta M is ejected, a group from which the ink having an ink color of yellow Y is ejected, and a group from which the ink having an ink color of black K is ejected. The number of head chips 300 provided in the ejection heads 100*a* to 100*f* may be two or more, and is not limited to six as illustrated in FIG. 11.

Figure 12:
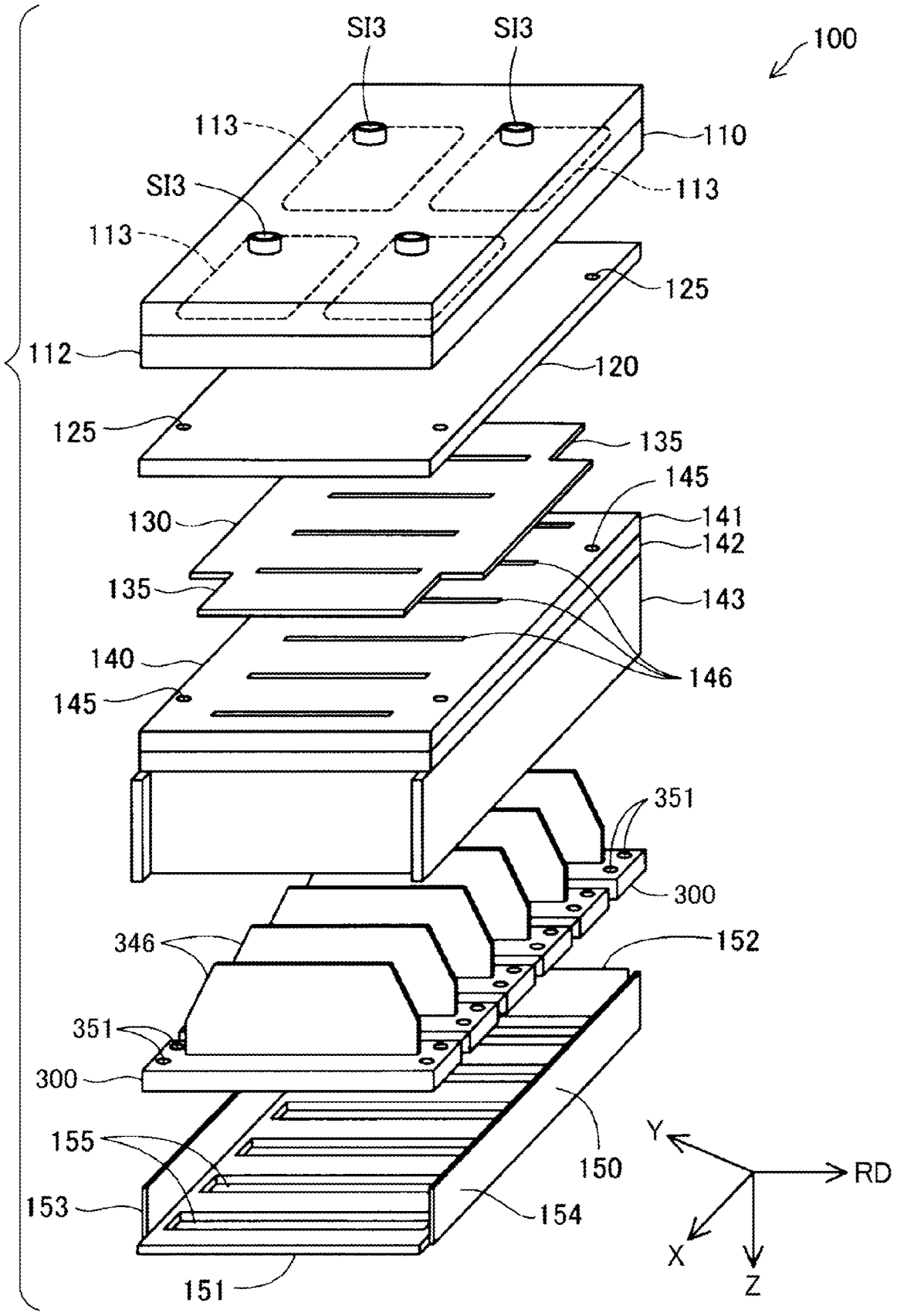
FIG. 12 is an exploded perspective view illustrating a schematic configuration of an ejection head.

Next, the structure of the ejection head 100 will be described. FIG. 12 is an exploded perspective view illustrating a schematic configuration of the ejection head 100. The ejection head 100 includes a filter unit 110, a seal member 120, a wiring substrate 130, a holder 140, six head chips 300, and a fixing plate 150. The ejection head 100 has a configuration in which the filter unit 110, the seal member 120, the wiring substrate 130, the holder 140, and the fixing plate 150 are disposed in this order from the −Z side to the +Z side along the Z direction. Further, the six head chips 300 are interposed between the holder 140 and the fixing plate 150.

The filter unit 110 has a substantially parallel quadrilateral shape in which two facing sides extend along the X direction and two facing sides extend along the row direction RD. The filter unit 110 includes four filters 113 and four third liquid introduction ports SI3. The four third liquid introduction ports SI3 are located toward the −Z side of the filter unit 110 and are provided corresponding to the four filters 113. Specifically, the four filters 113 are located inside the filter unit 110 and are provided corresponding to the respective four third liquid introduction ports SI3. The filter 113 collects air bubbles and foreign matter contained in the ink supplied from the third liquid introduction port SI3.

The seal member 120 is located toward the +Z side of the filter unit 110, and has a substantially parallel quadrilateral shape in which two facing sides extend along the X direction and two facing sides extend along the row direction RD. Through holes 125 through which the ink supplied from the filter unit 110 flows are provided at the four corners of the seal member 120. The seal member 120 is formed of, for example, an elastic member such as rubber. The seal member 120 is provided on the +Z side face of the filter unit 110, and communicates a liquid discharge hole (not illustrated)

communicating with the third liquid introduction port SI3 via the filter 113, and a liquid introduction port 145 of the holder 140, which will be described later, with in a liquid-tight manner.

The wiring substrate 130 is located toward the +Z side of the seal member 120, and has a substantially parallel quadrilateral shape in which two facing sides extend along the X direction and two facing sides extend along the row direction RD. Further, notches 135 provided so as not to block through holes 125 of the seal member 120 are formed at the respective four corners of the wiring substrate 130. The wiring substrate 130 includes wiring for propagating various signals such as the drive signals COMA and COMB and the voltage VHV supplied to the ejection head 100.

The holder 140 is located toward the +Z side of the wiring substrate 130, and has a substantially parallel quadrilateral shape in which two facing sides extend along the X direction and two facing sides extend along the row direction RD. The holder 140 includes a first holder member 141, a second holder member 142, and a third holder member 143. The first holder member 141, the second holder member 142, and the third holder member 143 are disposed in the order of the first holder member 141, the second holder member 142, and the third holder member 143 from the −Z side to the +Z side along the Z direction. Further, the first holder member 141 and the second holder member 142, and the second holder member 142 and the third holder member 143 are adhered with an adhesive or the like.

Further, inside the third holder member 143, and accommodation spaces (not illustrated) each having an opening toward the +Z side and accommodating the respective head chip 300 are formed corresponding to the respective six head chips 300. Further, the holder 140 has slit holes 146 corresponding to the respective six head chips 300. Each of the six head chips 300 is accommodated in the corresponding accommodation space, and is adhered with an adhesive or the like with a flexible wiring substrate 346 for propagating various signals such as the drive signals COMA and COMB and the voltage VHV to the head chip 300 inserted into the slit hole 146.

Further, four liquid introduction ports 145 are provided at the four corners of the upper face of the holder 140. The liquid introduction ports 145 are coupled to the respective through holes 125 provided in the seal member 120. As a result, the ink is supplied to the liquid introduction port 145. Then, the ink introduced from each liquid introduction port 145 is distributed to the six head chips 300 through four systems of ink flow paths communicating with the four liquid introduction ports 145 provided inside the holder 140.

The fixing plate 150 is located toward the +Z side of the holder 140 and seals the accommodation space formed inside the third holder member 143. The fixing plate 150 has a flat face portion 151, a first bent portion 152, a second bent portion 153, and a third bent portion 154. The flat face portion 151 has a substantially parallel quadrilateral shape in which two facing sides extend along the X direction and two facing sides extend along the row direction RD. The flat face portion 151 has six openings 155 for exposing the head chip 300. The flat face portion 151 is fixed to the third holder member 143 of the holder 140 while the head chips 300 are fixed so that two rows of nozzle rows are exposed through the opening 155.

The first bent portion 152 is a member, integrated with the flat face portion 151, that is coupled to one side of the flat face portion 151 extending along the X direction and that is bent to the −Z side, the second bent portion 153 is a member, integrated with the flat face portion 151, that is coupled to one side of the flat face portion 151 extending along the row direction RD and that is bent to the −Z side, the third bent portion 154 is a member, integrated with the flat face portion 151, that is coupled to the other side of the flat face portion 151 extending along the row direction RD and that is bent toward the −Z side.

The head chip 300 is located toward the +Z side of the holder 140 and toward the −Z side of the fixing plate 150. That is, the head chip 300 is located between the holder 140 and the fixing plate 150. Then, at least part of the head chip 300 is accommodated in the accommodation space formed by the third holder member 143 of the holder 140.

Figure 13:
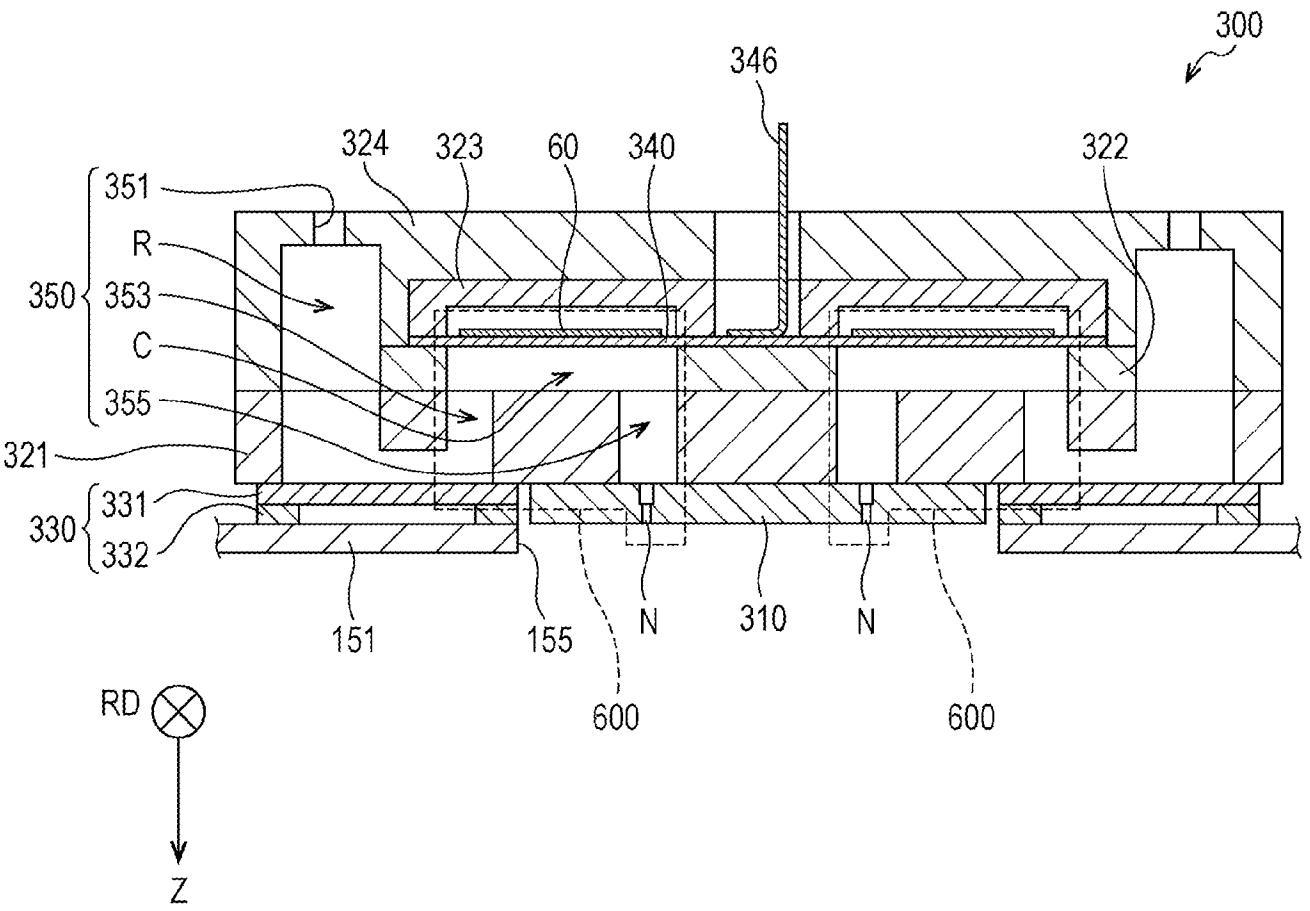
FIG. 13 is a diagram illustrating a schematic structure of a head chip.

Here, an example of the structure of the head chip 300 will be described. FIG. 13 is a diagram illustrating a schematic structure of the head chip 300, and is a cross-sectional view thereof when the head chip 300 is cut in a direction perpendicular to the row direction RD so as to include at least one nozzle N. As illustrated in FIG. 13, the head chip 300 includes a nozzle plate 310 having a plurality of nozzles N from which the ink is ejected, a flow path forming substrate 321 defining a communication flow path 355, an individual flow path 353, and a reservoir R, a pressure chamber substrate 322 defining a pressure chamber C, a protective substrate 323, a compliance unit 330, a vibration plate 340, the piezoelectric element 60, the flexible wiring substrate 346, and a case 324 defining the reservoir R and a liquid introduction port 351. Then, the ink is supplied to the head chip 300 from a liquid discharge port (not illustrated) provided in the holder 140 via the liquid introduction port 351. The ink supplied to the head chip 300 reaches the nozzle N via an ink flow path 350 including the reservoir R, the individual flow path 353, the pressure chamber C, and the communication flow path 355 to be ejected when the piezoelectric element 60 is driven.

Here, the configuration including the piezoelectric element 60, the vibration plate 340, the nozzle N, the individual flow path 353, the pressure chamber C, and the communication flow path 355 corresponds to the ejection unit 600.

Specifically, the ink flow path 350 has a configuration in which the flow path forming substrate 321, the pressure chamber substrate 322, and the case 324 are laminated along the Z direction. The ink introduced into the case 324 from the liquid introduction port 351 is stored in the reservoir R. The reservoir R is a common flow path communicating with a plurality of individual flow paths 353 corresponding to the plurality of respective nozzles N each composing the nozzle row. The ink stored in the reservoir R is supplied to the pressure chamber C via the individual flow path 353.

When applying pressure to the stored ink in the pressure chamber C, the ink is ejected from the nozzle N through the communication flow path 355. The vibration plate 340 is located toward the −Z side of the pressure chamber C so as to seal the pressure chamber C, and the piezoelectric element 60 is located toward the −Z side of the vibration plate 340. The piezoelectric element 60 is composed of a piezoelectric body and a pair of electrodes formed on both sides of the piezoelectric body. When the drive signal VOUT is supplied to one of the pair of electrodes of the piezoelectric element 60 via the flexible wiring substrate 346, and the reference voltage signal VBS is supplied to the other of the pair of electrodes of the piezoelectric element 60 via the flexible wiring substrate 346, the piezoelectric body is displaced due to the potential difference generated between the pair of electrodes, and as a result, the piezoelectric element 60 including the piezoelectric body is driven. With the drive of the piezoelectric element 60, the vibration plate 340 provided with the piezoelectric element 60 is deformed, and the internal pressure of the pressure chamber C is changed due to the deformation of the vibration plate 340, so that the ink stored in the pressure chamber C is ejected from the nozzle N via the communication flow path 355.

Further, the nozzle plate 310 and the compliance unit 330 are fixed to the +Z side face of the flow path forming substrate 321. The nozzle plate 310 is located toward the +Z side of the communication flow path 355. A plurality of nozzles N is disposed side by side in the nozzle plate 310 along the row direction RD. The compliance unit 330 is located toward the +Z side of the reservoir R and the individual flow path 353, and includes a sealing film 331 and a support 332. The sealing film 331 is a flexible film-like member, and seals the +Z side faces of the reservoir R and the individual flow path 353. The outer peripheral edge of the sealing film 331 is supported by the frame-shaped support 332. Further, the +Z side face of the support 332 is fixed to the flat face portion 151 of the fixing plate 150. The compliance unit 330 configured as described above protects the head chip 300 and reduces pressure fluctuations of the ink inside the reservoir R and inside the individual flow path 253.

Returning to FIG. 12, as described above, the ejection head 100 distributes the ink supplied from the liquid container 5 to the plurality of nozzles N and ejects the ink from the nozzle N by driving the piezoelectric element 60 generated based on the drive signal VOUT supplied via the flexible wiring substrate 346. Here, the drive signal selection circuit 200 may be provided on the wiring substrate 130, or may be provided on the flexible wiring substrate 346 corresponding to each of the head chips 300.

Returning to FIGS. 9 and 10, the ejection controller G4 is located toward the −Z side of the flow path structure G1 and includes a wiring substrate 410 and a wiring substrate 420. The wiring substrate 410 has a face 411 and a face 412 located opposite to the face 411. The wiring substrate 410 is disposed so that the face 412 faces toward the flow path structure G1, the supply controller G2, and the liquid ejection unit G3, and the face 411 faces away from the flow path structure G1, the supply controller G2, and the liquid ejection unit G3.

The drive signal output circuit 50 that outputs the drive signals COMA and COMB is provided on the face 411 of the wiring substrate 410. Specifically, four sets of class D amplifier circuits each set of which outputs the drive signals COMA1, COMB1, COMA2, and COMB2 output by the drive signal output circuit 50, that is, for more information, a total of four sets where each set includes a semiconductor device that controls the operation of the class D amplifier circuit, a pair of transistors that amplifies the signal output from the semiconductor device, and a coil and a capacitor that smooth the signal output to the midpoint of the pair of transistors, are provided on the face 411.

Further, a connector 413 is provided on the face 412 of the wiring substrate 410. The connector 413 propagates the drive signals COMA1, COMB1, COMA2, and COMB2, generated by the drive signal output circuit 50, output to the ejection head 100, and propagates a plurality of signals including the base drive signals dA1, dB1, dA2, and dB2 which are the basis of the drive signals COMA1, COMA2, COMB1, and COMB2 input to the drive signal output circuit 50.

That is, in the head unit 20, the wiring substrate 410 is disposed so that the face 411 on which the drive signal output circuit 50 is provided is away from the ejection head 100 that ejects the ink. In other words, the wiring substrate 410 is provided so that the shortest distance between the nozzle plate 310 of the head chip 300 included in the ejection head 100 of the liquid ejection unit G3 and the face 412 opposite to the face 411 on which the drive signal output circuit 50 is shorter than the shortest distance between the nozzle plate 310 of the head chip 300 included in the ejection head 100 of the liquid ejection unit G3 and the face 411.

As a result, the wiring substrate 410 is located between the ejection head 100 and the drive signal output circuit 50, the risk of heat generated by the drive signal output circuit 50 being conducted to the ejection head 100 is reduced by the wiring substrate 410, therefore, the possibility that the heat generated in the drive signal output circuit 50 affects the characteristics of the ink stored in the ejection head 100 is reduced. That is, in the liquid ejection apparatus 1, the influence of the heat generated in the drive signal output circuit 50 on the ink ejection characteristics is reduced.

Specifically, as illustrated in FIGS. 9 and 10, the wiring substrate 410 is provided so that the face 411 is directed upward in the vertical direction and faces the −Z side, and the face 412 is directed downward in the vertical direction and faces the +Z side along the Z direction, which is the vertical direction, so that the wiring substrate 410 makes it possible to further reduce the possibility that the heat generated in the drive signal output circuit 50 is conducted to the ejection head 100, and in the liquid ejection apparatus 1, the influence of the heat generated in the drive signal output circuit 50 on the ink ejection characteristics can be further reduced.

Here, the wiring substrate 410 on which the drive signal output circuit 50 that outputs the drive signals COMA and COMB is provided is an example of the first substrate, and the face 411, of the wiring substrate 410, on which the drive signal output circuit 50 is provided is an example of the first face, and the face 412 opposite to the face 411 is an example of the second face.

The wiring substrate 420 includes a face 421 and a face 422 opposite to the face 421. The wiring substrate 420 is located toward the +Z side of the wiring substrate 410, and is provided so that the face 421 is directed upward in the vertical direction and faces the −Z side, and the face 422 is directed upward in the vertical direction and faces the +Z side along the Z direction, which is the vertical direction. That is, the wiring substrate 420 is located between the wiring substrate 410, and the flow path structure G1, the supply controller G2, and the liquid ejection unit G3. In other words, at least part of the wiring substrate 420 is located between the wiring substrate 410 and the ejection head 100 included in the liquid ejection unit G3.

A semiconductor device 423 is provided in the −X side region of the face 421 of the wiring substrate 420. The semiconductor device 423 is a circuit component that constitutes at least part of a head control circuit 21 illustrated in FIG. 2, and includes, for example, an SoC. That is, the image information signal IP input from the control unit 10 to the head unit 20 is input to the semiconductor device 423. Then, the semiconductor device 423 generates various signals based on the input image information signal IP to output them to the corresponding configuration such as the drive signal output circuit 50 or the like. That is, the semiconductor device 423 that is electrically coupled to the drive signal output circuit 50 is provided on the face 421 of the wiring substrate 420 included in the head unit 20.

Further, a connector 424 is provided in a region located toward the +X side relative to the semiconductor device 423 and along the end side, of the wiring substrate 420, located toward the −Y side in the face 421 of the wiring substrate 420. The connector 424 is a board to board (BtoB) connector that electrically couples the wiring substrate 410 and the wiring substrate 420 when coupled to the connector 413 provided on the wiring substrate 410. As a result, the wiring substrate 420 is electrically coupled to the wiring substrate 410.

Here, the semiconductor device 423 electrically coupled to the drive signal output circuit 50 is an example of the integrated circuit, the wiring substrate 420 on which the semiconductor device 423 is provided is an example of the second substrate, the face 421 of the wiring substrate 420 is an example of the third face, and the face 422 is an example of the fourth face.

As described above, the ejection controller G4 includes the semiconductor device 423 that constitutes at least part of the head control circuit 21 and the drive signal output circuit 50, and based on the image information signal IP output from the control unit 10, generates various signals, as the signals for controlling the ejection head 100, including the drive signals COMA and COMB illustrated in FIGS. 1A and 1B to output the generated various signals to the ejection head 100, thereby controlling an ejection of the ink from the ejection head 100.

In the head unit 20 configured as described above, the ejection controller G4 generates, based on the image information signal IP that is output by the control unit 10 and that is input to the head unit 20, various signals for controlling the ejection head 100 to output the generated various signals to the ejection head 100 included in the liquid ejection unit G3, and the flow path structure G1 and the supply controller G2 distribute and supply the ink supplied from the liquid container 5 to each of the ejection heads 100 included in the liquid ejection unit G3. The ejection head 100 included in the liquid ejection unit G3 ejects, based on various signals input from the ejection controller G4, the ink supplied via the flow path structure G1 and the supply controller G2 to form a desired image on the medium P.

Here, as illustrated in FIGS. 9 and 10, it is preferable that the semiconductor device 423 provided on the wiring substrate 420 included in the ejection controller G4 be not located between the wiring substrate 410 and the wiring substrate 420. That is, it is preferable that at least part of the semiconductor device 423 provided on the wiring substrate 420 is provided at a position where it does not overlap the wiring substrate 410 in the direction from the face 421 to the face 422 of the wiring substrate 420 and in a direction along the Z direction.

As described above, since the semiconductor device 423 is included in the head control circuit 21 that outputs a control signal for controlling each unit of the head unit 20 based on the image information signal IP input from the main control circuit 11, the semiconductor device 423 is required to operate stably. At least part of such a semiconductor device 423 is located at a position where it does not overlap the wiring substrate 410 on which the drive signal output circuit 50 in the direction from the face 421 to the face 422 of the wiring substrate 420, so that the possibility that the characteristics of the semiconductor device 423 will change due to the heat generated by the drive signal output circuit 50 is reduced. As a result, the operation of the semiconductor device 423 is stable, and the operation of the head unit 20 is stable.

Further, the semiconductor device 423 is provided at a position where it does not overlap the wiring substrate 410 in the direction along the Z direction, so that it is possible to provide an air layer between the wiring substrate 410 on which the drive signal output circuit 50 is provided and the wiring substrate 420 on which the semiconductor device 423 is provided. This air layer makes it possible to further reduce the possibility that the heat generated in the drive signal output circuit 50 is conducted to the ejection head 100, and as a result, in the liquid ejection apparatus 1, the influence of the heat generated in the drive signal output circuit 50 on the ink ejection characteristics can be further reduced.

Here, any of the ejection heads 100*a* to 100*f* included in the head unit 20 is an example of the first ejection head, the piezoelectric element 60 included in any of the ejection heads 100*a* to 100*f* corresponding to the first ejection head is an example of the first drive element, the drive signal selection circuit 200 included in any of the ejection heads 100*a* to 100*f* corresponding to the first ejection head is an example of the first switching circuit, the nozzle N included in any of the ejection heads 100*a* to 100*f* corresponding to the first ejection head is an example of the first nozzle, and the nozzle plate 310 in which the nozzle N corresponding to the first nozzle is formed is an example of the first nozzle plate.

Further, any of the ejection heads 100*a* to 100*f* that is included in the head unit 20, but that is different from any of the ejection heads 100*a* to 100*f* corresponding to the first ejection head is an example of the second ejection head, the piezoelectric element 60 included in any of the ejection heads 100*a* to 100*f* corresponding to the second ejection head is an example of the second drive element, the drive signal selection circuit 200 included in any of the ejection heads 100*a* to 100*f* corresponding to the second ejection head is an example of the second switching circuit, the nozzle N included in any of the ejection heads 100*a* to 100*f* corresponding to the second ejection head is an example of the second nozzle, and the nozzle plate 310 in which the nozzle N corresponding to the second nozzle is formed is an example of the second nozzle plate.

5. Functions and Effects

As described above, in the liquid ejection apparatus 1 of the present embodiment, the head unit 20 includes the wiring substrate 410 on which the drive signal output circuit 50 is provided and the ejection head 100 that ejects the ink. The drive signal output circuit 50 is provided on the face 411, of the wiring substrate 410, that is away from the ejection head 100, so that the possibility that the heat generated in the drive signal output circuit 50 is conducted to the ejection head 100 is reduced. As a result, the possibility that the ink stored in the ejection head 100 is affected by the heat generated in the drive signal output circuit 50 is reduced. That is, the possibility that the heat generated in the drive signal output circuit 50 affects the ejection characteristics of the ink ejected from the ejection head 100 is reduced.

In this case, the supply controller G2 and the liquid ejection unit G3, which function as flow path members that supplies the ink to the ejection head 100, are located between the wiring substrate 410 and the ejection head 100, so that the possibility that the heat generated in the drive signal output circuit 50 is conducted to the ejection head 100 is further reduced. As a result, the possibility that the heat generated in the drive signal output circuit 50 affects the ejection characteristics of the ink ejected from the ejection head 100 is further reduced.

6. Modification

In the liquid ejection apparatus 1 described above, the drive signal output circuit 50 is provided on the wiring substrate 410, and the semiconductor device 423 is provided on the wiring substrate 420. That is, description is made in which the drive signal output circuit 50 and the semiconductor device 423 are provided on different substrates, but as illustrated in FIGS. 14 and 15, the drive signal output circuit 50 and the semiconductor device 423 may be provided on the same wiring substrate 430.

Figure 14:
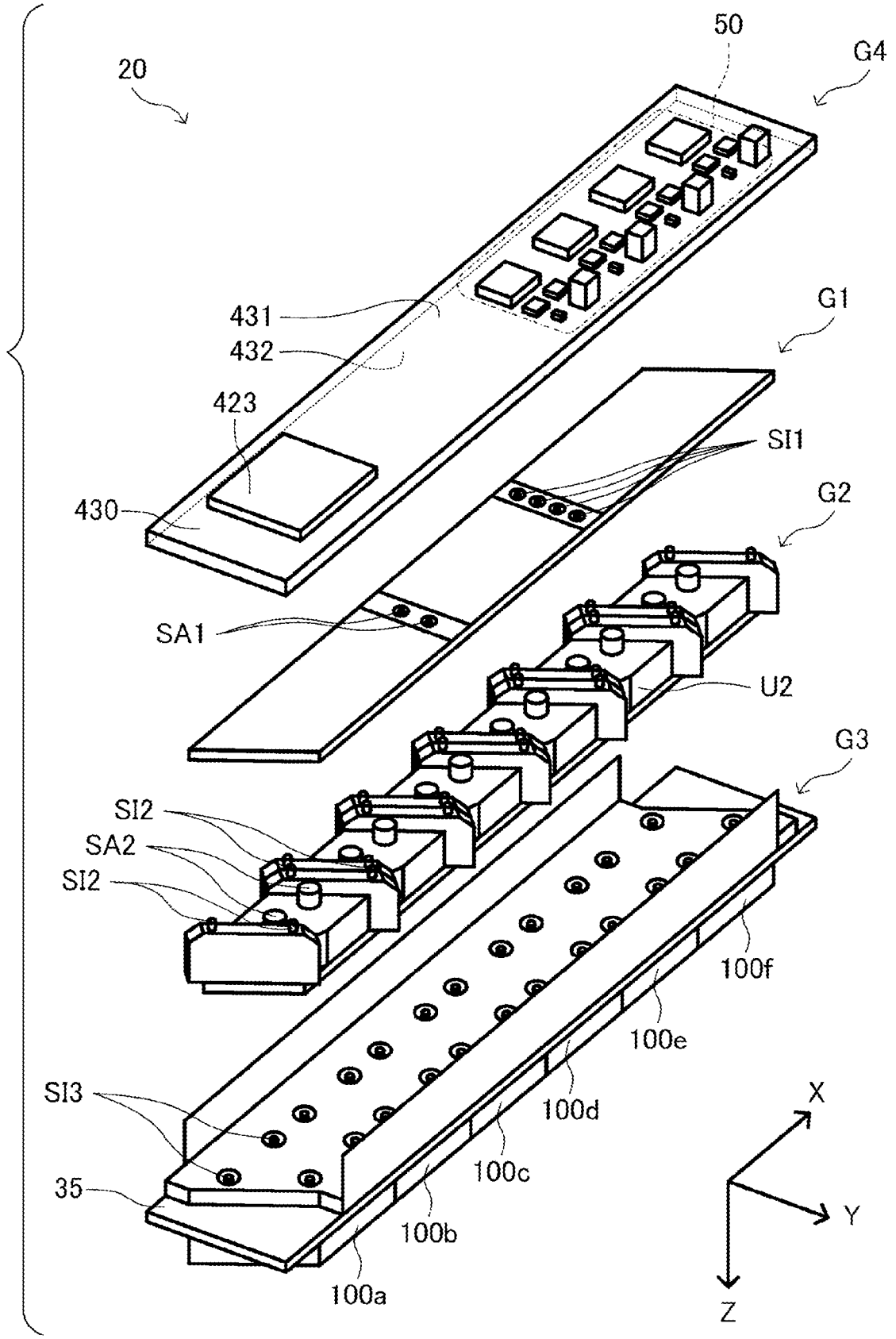
FIG. 14 is an exploded perspective view of a modification of a head unit when viewed from the −Z side.
Figure 15:
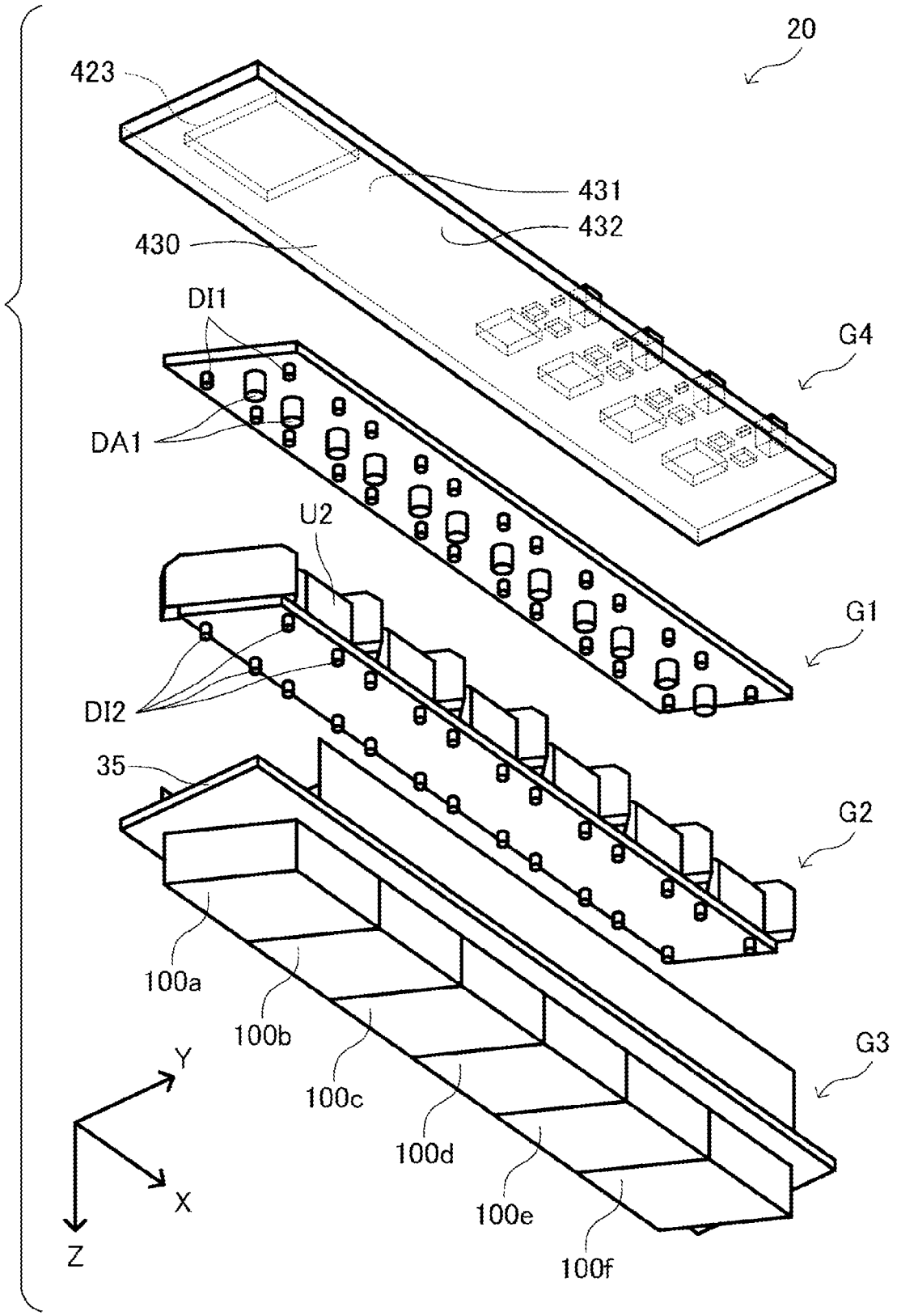
FIG. 15 is an exploded perspective view of a modification of the head unit when viewed from the +Z side.

FIG. 14 is an exploded perspective view of the modification head unit 20 viewed from the −Z side, and FIG. 15 is an exploded perspective view of the modification head unit 20 viewed from the +Z side.

As illustrated in FIGS. 14 and 15, the ejection controller G4 includes the wiring substrate 430 whose face 432 faces toward the flow path structure G1, the supply controller G2, and the liquid ejection unit G3, whose face 431 faces away from the flow path structure G1, the supply controller G2, and the liquid ejection unit G3. The semiconductor device 423 constituting at least part of the head control circuit 21 illustrated in FIGS. 1A and 1B and the drive signal output circuit 50 that outputs the drive signals COMA and COMB are provided on the face 431 of the wiring substrate 430.

With the head unit 20 configured as described above, the wiring substrate 430 is located between the ejection head 100 and the drive signal output circuit 50, so that the possibility that the heat generated by the drive signal output circuit 50 is conducted to the ejection head 100 is reduced by the wiring substrate 430, and thus the possibility that the heat generated in the drive signal output circuit 50 affects the characteristics of the ink stored in the ejection head 100 is reduced. That is, in the liquid ejection apparatus 1, the influence of the heat generated in the drive signal output circuit 50 on the ink ejection characteristics is reduced.

Further, in the liquid ejection apparatus 1 described above, the drive signal output circuit 50 may include a heat dissipation mechanism for releasing the generated heat, and the heat dissipation mechanism is located on the −Z side of the drive signal output circuit 50, and is coupled to the drive signal output circuit 50 away from the flow path structure G1, the supply controller G2, and the liquid ejection unit G3.

In the liquid ejection apparatus 1 configured as described above, the heat dissipation mechanism makes it possible to release the heat generated in the drive signal output circuit 50, and it is possible to reduce a rise in temperature of the drive signal output circuit 50. Further, the heat dissipation mechanism is located on the −Z side of the drive signal output circuit 50, and is coupled to the drive signal output circuit 50 away from the flow path structure G1, the supply controller G2, and the liquid ejection unit G3, so that it is possible to reduce the possibility that the heat, generated in the drive signal output circuit 50, which is conducted via the heat dissipation mechanism affects the ejection head 100, and as a result, in the liquid ejection apparatus 1, the influence of the heat generated in the drive signal output circuit 50 on the ink ejection characteristics is reduced.

Although the embodiments and the modification have been described above, the present disclosure is not limited to the embodiments and the modification, and can be implemented in various modes without departing from the gist of the disclosure. For example, the above embodiments can be appropriately combined.

The disclosure includes a configuration substantially same as the configuration described in the embodiments (for example, a configuration having the same function, method, and result, or a configuration having the same object and effect). Further, the disclosure includes a configuration in which a non-essential part of the configuration described in the embodiments is replaced. Further, the disclosure includes a configuration having the same functions and effects as the configuration described in the embodiments or a configuration capable of achieving the same object. The disclosure also includes a configuration in which a known technique is added to the configuration described in the embodiments.

The following contents are derived from the above-described embodiments and modifications.

An aspect of the liquid ejection apparatus includes a head unit that ejects a liquid, and a control unit that controls an operation of the head unit, wherein the head unit includes a drive signal output circuit that outputs a drive signal, a first substrate on which the drive signal output circuit is provided, and a first ejection head including a first drive element driven by the drive signal, a first switching circuit that switches whether to supply the drive signal to the first drive element, and a first nozzle plate including a first nozzle from which a liquid is ejected by driving the first drive element, wherein the first substrate includes a first face and a second face, wherein the drive signal output circuit is provided on the first face, and wherein a shortest distance between the first nozzle plate and the second face is shorter than a shortest distance between the first nozzle plate and the first face.

According to the liquid ejection apparatus, the drive signal output circuit and the first ejection head are provided in the same head unit, so that it is possible to shorten the wiring length coupling the drive signal output circuit and the first ejection head, and the accuracy of the drive signal supplied to the first ejection head can be improved. Further, the shortest distance between the first nozzle plate included in the first ejection head and the second face, of the first substrate, on which the drive signal output circuit is not provided is of the first substrate on which the drive signal output circuit is provided, is shorter than the shortest distance between the first nozzle plate included in the first ejection head and the first face, of the first substrate, on which the drive signal output circuit is provided and, so that the heat, generated in the drive signal output circuit, conducted toward the first ejection head is reduced by the first substrate. Therefore, it is possible to reduce the possibility that the heat generated in the drive signal output circuit affects the first ejection head.

In an aspect of the liquid ejection apparatus, the first substrate may be provided so that the first face faces upward and the second face faces downward in a direction along a vertical direction.

According to the liquid ejection apparatus the heat generated in the drive signal output circuit is more difficult to conduct to the first ejection head, and the first face on which the drive signal output circuit is provided faces vertically upward, so that the heat dissipation efficiency of the heat generated in the drive signal output circuit is improved.

In an aspect of the liquid ejection apparatus, the head unit may include a flow path member that supplies a liquid to the first ejection head, and wherein the flow path member may be located between the first substrate and the first nozzle plate.

According to the liquid ejection apparatus, the heat generated in the drive signal output circuit conducted toward the first ejection head is reduced by the flow path member. Therefore, the possibility that the heat generated in the drive signal output circuit affects the first ejection head can be further reduced.

In an aspect of the liquid ejection apparatus, the head unit may include an integrated circuit that is electrically coupled to the drive signal output circuit, and a second substrate that has a third face and a fourth face and on which the integrated circuit is provided, and wherein the second substrate may be electrically coupled to the first substrate.

According to the liquid ejection apparatus, it is possible to provide a wide space around the drive signal output circuit for releasing the heat, and it is possible to further improve the heat dissipation efficiency of the drive signal output circuit.

In an aspect of the liquid ejection apparatus, the integrated circuit may be provided on the third face, and wherein at least part of the integrated circuit may not overlap the first substrate in a direction from the third face toward the fourth face.

According to the liquid ejection apparatus, the possibility that the heat generated in the drive signal output circuit affects the integrated circuit is reduced, and as a result, the operational stability of the integrated circuit can be improved.

In an aspect of the liquid ejection apparatus, at least part of the second substrate may be located between the first substrate and the first ejection head.

According to the liquid ejection apparatus, the heat generated in the drive signal output circuit conducted toward the first ejection head is reduced by both the first substrate and the second substrate. Therefore, the possibility that the heat generated in the drive signal output circuit affects the first ejection head can be further reduced.

In an aspect of the liquid ejection apparatus, the head unit may include a second ejection head including a second drive element driven by the drive signal, a second selection circuit that switches whether to supply the drive signal to the second drive element, and a second nozzle plate including a second nozzle from which a liquid is ejected by driving the second drive element, and wherein a shortest distance between the second nozzle plate and the second face may be shorter than a shortest distance between the second nozzle plate and the first face.

According to the liquid ejection apparatus, the heat generated in the drive signal output circuit conducted toward the second ejection head is reduced by the first substrate. Therefore, it is possible to reduce the possibility that the heat generated in the drive signal output circuit affects the second ejection head.

An aspect of the head unit includes a drive signal output circuit that outputs a drive signal, a first substrate on which the drive signal output circuit is provided, and a first ejection head including a first drive element driven by the drive signal, a first switching circuit that switches whether to supply the drive signal to the first drive element, and a first nozzle plate including a first nozzle from which a liquid is ejected by driving the first drive element, wherein the first substrate includes a first face and a second face, wherein the drive signal output circuit is provided on the first face, and wherein a shortest distance between the first nozzle plate and the second face is shorter than a shortest distance between the first nozzle plate and the first face.

According to the head unit, the drive signal output circuit and the first ejection head are provided in the same head unit, so that it is possible to shorten the wiring length coupling the drive signal output circuit and the first ejection head, and the accuracy of the drive signal supplied to the first ejection head can be improved. Further, the shortest distance between the first nozzle plate included in the first ejection head and the second face, of the first substrate, on which the drive signal output circuit is not provided is of the first substrate on which the drive signal output circuit is provided, is shorter than the shortest distance between the first nozzle plate included in the first ejection head and the first face, of the first substrate, on which the drive signal output circuit is provided and, so that the heat, generated in the drive signal output circuit, conducted toward the first ejection head is reduced by the first substrate. Therefore, it is possible to reduce the possibility that the heat generated in the drive signal output circuit affects the first ejection head.

What is claimed is:

1. A liquid ejection apparatus comprising:

a head unit that ejects a liquid; and a control unit that controls an operation of the head unit, the head unit including a drive signal output circuit that outputs a drive signal, a first substrate on which the drive signal output circuit is provided, a first ejection head including a piezoelectric element driven by the drive signal, a first switching circuit that switches whether to supply the drive signal to the piezoelectric element, and a first nozzle plate including a first nozzle from which a liquid is ejected by driving the piezoelectric element, an integrated circuit that is electrically coupled to the drive signal output circuit, and a second substrate on which the integrated circuit is provided, the drive signal output circuit, the first substrate, the first ejection head being arranged such that the first substrate is disposed between the drive signal output circuit and the first ejection head in an arrangement direction, and such that the drive signal output circuit and the piezoelectric element overlap each other in the arrangement direction, the first substrate including a first face and a second face opposite to the first face in the arrangement direction, the drive signal output circuit being provided on the first face, a shortest distance between the first nozzle plate and the second face being shorter than a shortest distance between the first nozzle plate and the first face, the second substrate having a third face and a fourth face, the second substrate being electrically coupled to the first substrate, and the integrated circuit being provided on the third face, wherein at least part of the integrated circuit does not overlap the first substrate in a direction from the third face toward the fourth face.

2. The liquid ejection apparatus according to claim 1, wherein the first substrate is provided so that the first face faces upward and the second face faces downward in a direction along a vertical direction, and the arrangement direction is the vertical direction.

3. The liquid ejection apparatus according to claim 1, wherein the head unit includes a flow path member that supplies a liquid to the first ejection head, and the flow path member is located between the first substrate and the first nozzle plate.

4. The liquid ejection apparatus according to claim 1, wherein the head unit includes a second ejection head including a drive element driven by the drive signal, a second selection circuit that switches whether to supply the drive signal to the drive element, and a second nozzle plate including a second nozzle from which a liquid is ejected by driving the drive element, and a shortest distance between the second nozzle plate and the second face is shorter than a shortest distance between the second nozzle plate and the first face.

5. The liquid ejection apparatus according to claim 1, wherein the third surface and the fourth face are opposite to each other in the arrangement direction, and at least part of the integrated circuit does not overlap the first substrate in the arrangement direction.

6. A liquid ejection apparatus comprising:

a head unit that ejects a liquid; and a control unit that controls an operation of the head unit, the head unit including a drive signal output circuit that outputs a drive signal, a first substrate on which the drive signal output circuit is provided, a first ejection head including a piezoelectric element driven by the drive signal, a first switching circuit that switches whether to supply the drive signal to the piezoelectric element, and a first nozzle plate including a first nozzle from which a liquid is ejected by driving the piezoelectric element, an integrated circuit that is electrically coupled to the drive signal output circuit, and a second substrate on which the integrated circuit is provided, the drive signal output circuit, the first substrate, the first ejection head being arranged such that the first substrate is disposed between the drive signal output circuit and the first ejection head in an arrangement direction, and such that the drive signal output circuit and the piezoelectric element overlap each other in the arrangement direction, the first substrate including a first face and a second face opposite to the first face in the arrangement direction, the drive signal output circuit being provided on the first face, a shortest distance between the first nozzle plate and the second face being shorter than a shortest distance between the first nozzle plate and the first face, the second substrate having a third face and a fourth face, the second substrate being electrically coupled to the first substrate, and at least part of the second substrate being located between the first substrate and the first ejection head.

7. A head unit comprising:

a drive signal output circuit that outputs a drive signal;

a first substrate on which the drive signal output circuit is provided;

a first ejection head including a piezoelectric element driven by the drive signal, a first switching circuit that switches whether to supply the drive signal to the piezoelectric element, and a first nozzle plate including a first nozzle from which a liquid is ejected by driving the piezoelectric element;

an integrated circuit that is electrically coupled to the drive signal output circuit; and a second substrate on which the integrated circuit is provided, the drive signal output circuit, the first substrate, the first ejection head being arranged such that the first substrate is disposed between the drive signal output circuit and the first ejection head in an arrangement direction, and such that the drive signal output circuit and the piezoelectric element overlap each other in the arrangement direction, the first substrate including a first face and a second face opposite to the first face in the arrangement direction, the drive signal output circuit being provided on the first face, a shortest distance between the first nozzle plate and the second face being shorter than a shortest distance between the first nozzle plate and the first face, the second substrate having a third face and a fourth face, the second substrate being electrically coupled to the first substrate, and the integrated circuit being provided on the third face, wherein at least part of the integrated circuit does not overlap the first substrate in a direction from the third face toward the fourth face.

* * * * *